US009622006B2

(12) United States Patent
McGrath

(10) Patent No.: US 9,622,006 B2
(45) Date of Patent: Apr. 11, 2017

(54) METHOD AND SYSTEM FOR HEAD-RELATED TRANSFER FUNCTION GENERATION BY LINEAR MIXING OF HEAD-RELATED TRANSFER FUNCTIONS

(71) Applicant: DOLBY LABORATORIES LICENSING CORPORATION, San Francisco, CA (US)

(72) Inventor: David S. McGrath, Rose Bay (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 137 days.

(21) Appl. No.: 14/379,689

(22) PCT Filed: Mar. 21, 2013

(86) PCT No.: PCT/US2013/033233

§ 371 (c)(1),
(2) Date: Aug. 19, 2014

(87) PCT Pub. No.: WO2013/142653

PCT Pub. Date: Sep. 26, 2013

(65) Prior Publication Data

US 2016/0044430 A1 Feb. 11, 2016

Related U.S. Application Data

(60) Provisional application No. 61/614,610, filed on Mar. 23, 2012.

(51) Int. Cl.

| | |
|---|---|
| ***H04R 5/00*** | (2006.01) |
| ***H04S 1/00*** | (2006.01) |
| ***H04S 3/00*** | (2006.01) |

(52) U.S. Cl.

CPC ..... *H04S 1/002* (2013.01); *H04S 1/005* (2013.01); *H04S 3/002* (2013.01); *H04S 2420/01* (2013.01)

(58) Field of Classification Search

CPC . H04S 1/002; H04S 1/005; H04S 3/00; H04S 3/002; H04S 7/302; H04S 7/305; H04S 2420/00; H04S 2420/01

(Continued)

(56) References Cited

U.S. PATENT DOCUMENTS

| | | | |
|---|---|---|---|
| 5,173,944 A | 12/1992 | Begault | |
| 5,438,623 A | 8/1995 | Begault | |

(Continued)

FOREIGN PATENT DOCUMENTS

| | | | | |
|---|---|---|---|---|
| AU | 732016 | * | 8/1994 | ..... H04S 5/00 |
| AU | 732016 | | 4/2001 | |

(Continued)

OTHER PUBLICATIONS

Bauer, B.B. "Stereophonic Earphones and Binaural Loudspeakers" Journal of the Audio Engineering Society, Apr. 1961, vol. 9, No. 2, pp. 148-151.

(Continued)

*Primary Examiner* — Vivian Chin
*Assistant Examiner* — William A Jerez Lora
(74) *Attorney, Agent, or Firm* — Alfred A. Equitz

(57) ABSTRACT

A method for performing linear mixing on coupled Head-related transfer functions (HRTFs) to determine an interpolated HRTF for any specified arrival direction in a range (e.g., a range spanning at least 60 degrees in a plane, or a full range of 360 degrees in a plane), where the coupled HRTFs have been predetermined to have properties such that linear mixing can be performed thereon (to generate interpolated HRTFs) without introducing significant comb filtering distortion. In some embodiments, the method includes steps of: in response to a signal indicative of a specified arrival direction, performing linear mixing on data indicative of coupled HRTFs of a coupled HRTF set to determine an (Continued)

HRTF for the specified arrival direction; and performing HRTF filtering on an audio input signal using the HRTF for the specified arrival direction.

23 Claims, 7 Drawing Sheets

(58) Field of Classification Search
USPC ..... 381/1, 2, 17, 26, 56, 57, 58, 104, 107, 381/111, 307, 310, 313
See application file for complete search history.

(56) References Cited

U.S. PATENT DOCUMENTS

| | | | | |
|---|---|---|---|---|
| 5,659,619 | A | 8/1997 | Abel | |
| 5,751,817 | A | 5/1998 | Brungart | |
| 5,995,631 | A | 11/1999 | Kamada | |
| 6,021,206 | A | 2/2000 | McGrath | |
| 6,072,877 | A | 6/2000 | Abel | |
| 6,175,631 | B1 | 1/2001 | Davis | |
| 6,795,556 | B1 | 9/2004 | Sibbald | |
| 8,103,006 | B2 | 1/2012 | McGrath | |
| 2003/0076973 | A1 | 4/2003 | Yamada | |
| 2004/0247134 | A1* | 12/2004 | Miller, III | H04S 3/002 381/19 |
| 2006/0045294 | A1* | 3/2006 | Smyth | H04S 7/304 381/309 |
| 2008/0025519 | A1 | 1/2008 | Robinson | |
| 2008/0219454 | A1 | 9/2008 | Iida | |
| 2008/0273708 | A1* | 11/2008 | Sandgren | G10K 15/08 381/63 |
| 2010/0080396 | A1 | 4/2010 | Aoyagi | |
| 2010/0128880 | A1* | 5/2010 | Scholz | H04S 7/302 381/17 |
| 2010/0329466 | A1 | 12/2010 | Berge | |
| 2011/0064243 | A1 | 3/2011 | Katayama | |
| 2011/0116638 | A1 | 5/2011 | Son | |
| 2011/0135098 | A1 | 6/2011 | Kuhr | |
| 2011/0211702 | A1 | 9/2011 | Mundt | |
| 2012/0328107 | A1* | 12/2012 | Nystrom | H04S 7/303 381/17 |

FOREIGN PATENT DOCUMENTS

| | | |
|---|---|---|
| CN | 1879450 | 12/2006 |
| CN | ZL200980137321.3 | 8/2011 |
| JP | H11-503882 | 3/1999 |
| JP | 2009-508158 | 2/2009 |
| RU | 2427978 | 8/2011 |
| RU | 2443075 | 11/2011 |

OTHER PUBLICATIONS

Berge, S. et al. "A New Method for B-Format to Binaural Transcoding" AES 40th International Conference, Tokyo, Japan, Oct. 8, 2010.

MacPherson, E. et al "Listener Weighting of Cues for Lateral Angle: The Duplex Theory of Sound Localization Revisited" J. Acoustic Society Am. May 2002, pp. 2219-2236.

Matsumoto, M. et al "Effect of Arrival Time Correction on the Accuracy of Binaural Impulse Response Interpolation—Interpolation Methods of Binaural Response" JAES, AES, vol. 52, No. 1/2, Feb. 1, 2004, pp. 56-61.

* cited by examiner

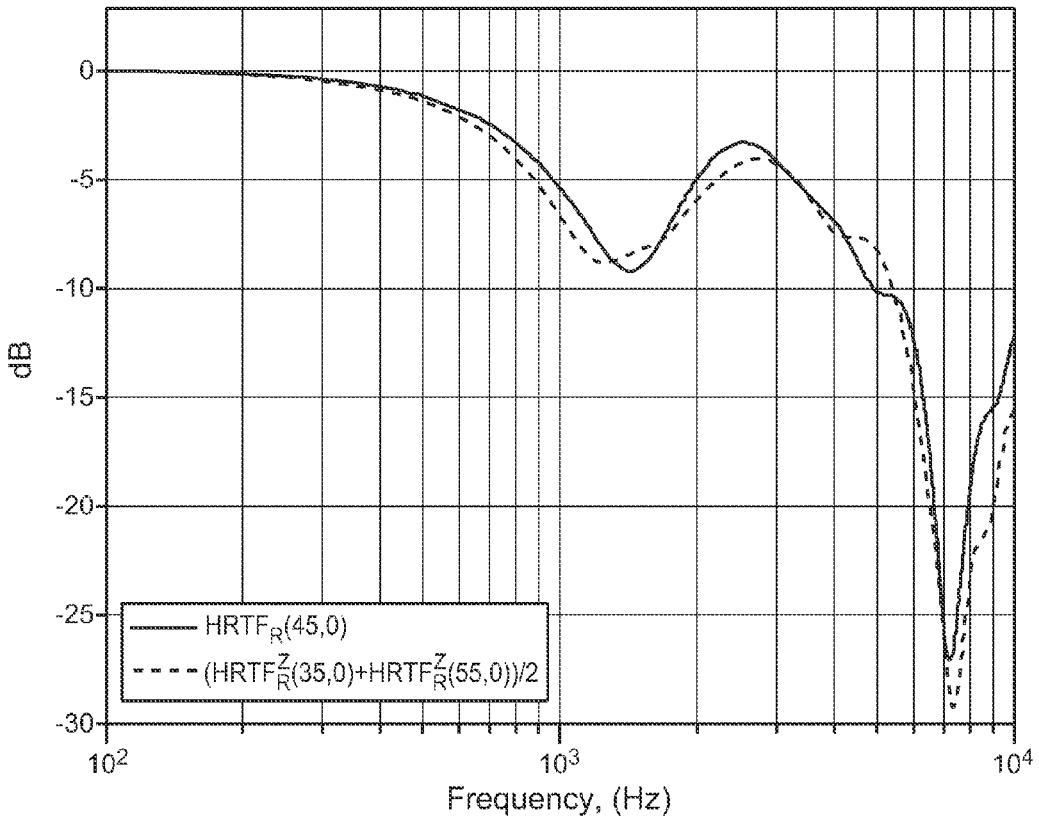
FIG. 7
FIG. 8
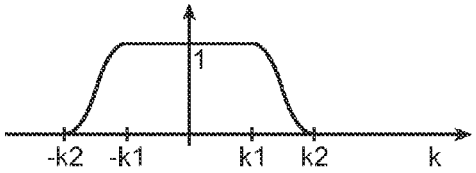
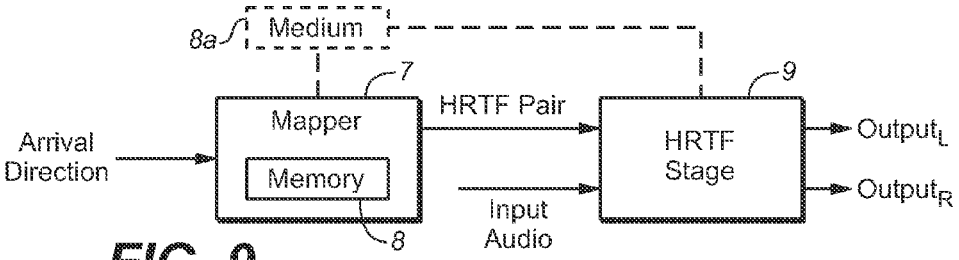
FIG. 9

METHOD AND SYSTEM FOR HEAD-RELATED TRANSFER FUNCTION GENERATION BY LINEAR MIXING OF HEAD-RELATED TRANSFER FUNCTIONS

CROSS-REFERENCE TO RELATED APPLICATIONS

This application claims priority to U.S. Patent Provisional Application No. 61/614,610, filed 23 Mar. 2012, which is hereby incorporated by reference in its entirety.

BACKGROUND OF THE INVENTION

1. Field of the Invention

The invention relates to methods and systems for performing interpolation on head-related transfer functions (HRTFs) to generate interpolated HRTFs. More specifically, the invention relates to methods and systems for performing linear mixing on coupled HRTFs (i.e., on values which determine the coupled HRTFs) to determine interpolated HRTFs, for performing filtering with the interpolated HRTFs, and for predetermining the coupled HRTFs to have properties such that interpolation can be performed thereon in an especially desirable manner (by linear mixing).

2. Background of the Invention

Throughout this disclosure, including in the claims, the expression performing an operation "on" signals or data (e.g., filtering, scaling, or transforming the signals or data) is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "linear mixing" of values (e.g., coefficients which determine head-related transfer functions) denotes determining a linear combination of the values. Herein, performing "linear interpolation" on head-related transfer functions (HRTFs) to determine an interpolated HRTF denotes performing linear mixing of the values which determine the HRTFs (determining a linear combination of such values) to determine values which determine the interpolated HRTF.

Throughout this disclosure including in the claims, the expression "system" is used in a broad sense to denote a device, system, or subsystem. For example, a subsystem that implements mapping may be referred to as a mapping system (or a mapper), and a system including such a subsystem (e.g., a system that performs various types of processing on audio input, in which the subsystem determines a transfer function for use in one of the processing operations) may also be referred to as a mapping system (or a mapper).

Throughout this disclosure, including in the claims, the term "render" denotes the process of converting an audio signal (e.g., a multi-channel audio signal) into one or more speaker feeds (where each speaker feed is an audio signal to be applied directly to a loudspeaker or to an amplifier and loudspeaker in series), or the process of converting an audio signal into one or more speaker feeds and converting the speaker feed(s) to sound using one or more loudspeakers. In the latter case, the rendering is sometimes referred to herein as rendering "by" the loudspeaker(s).

Throughout this disclosure, including in the claims, the terms "speaker" and "loudspeaker" are used synonymously to denote any sound-emitting transducer. This definition includes loudspeakers implemented as multiple transducers (e.g., woofer and tweeter).

Throughout this disclosure including in the claims, the verb "includes" is used in a broad sense to denote "is or includes," and other forms of the verb "include" are used in the same broad sense. For example, the expression "a filter which includes a feedback filter" (or the expression "a filter including a feedback filter") herein denotes either a filter which is a feedback filter (i.e., does not include a feedforward filter), or filter which includes a feedback filter (and at least one other filter).

Throughout this disclosure including in the claims, the term "virtualizer" (or "virtualizer system") denotes a system coupled and configured to receive N input audio signals (indicative of sound from a set of source locations) and to generate M output audio signals for reproduction by a set of M physical speakers (e.g., headphones or loudspeakers) positioned at output locations different from the source locations, where each of N and M is a number greater than one. N can be equal to or different than M. A virtualizer generates (or attempts to generate) the output audio signals so that when reproduced, the listener perceives the reproduced signals as being emitted from the source locations rather than the output locations of the physical speakers (the source locations and output locations are relative to the listener). For example, in the case that M=2 and N=1, a virtualizer upmixes the input signal to generate left and right output signals for stereo playback (or playback by headphones). For another example, in the case that M=2 and N>3, a virtualizer downmixes the N input signals for stereo playback. In another example in which N=M=2, the input signals are indicative of sound from two rear source locations (behind the listener's head), and a virtualizer generates two output audio signals for reproduction by stereo loudspeakers positioned in front of the listener such that the listener perceives the reproduced signals as emitting from the source locations (behind the listener's head) rather than from the loudspeaker locations (in front of the listener's head).

Head-related Transfer Functions ("HRTFs") are the filter characteristics (represented as impulse responses or frequency responses) that represent the way that sound in free space propagates to the two ears of a human subject. HRTFs vary from one person to another, and also vary depending on the angle of arrival of the acoustic waves. Application of a right ear HRTF filter (i.e., application of a filter having a right ear HRTF impulse response) to a sound signal, x(t), would produce an HRTF filtered signal, $x_R(t)$, indicative of the sound signal as it would be perceived by a listener after propagating in a specific arrival direction from a source to the listener's right ear. Application of a left ear HRTF filter (i.e., application of a filter having a left ear HRTF impulse response) to the sound signal, x(t), would produce an HRTF filtered signal, $x_L(t)$, indicative of the sound signal as it would be perceived by the listener after propagating in a specific arrival direction from a source to the listener's left ear.

Although HRTFs are often referred to herein as "impulse responses," each such HRTF could alternatively be referred to by other expressions, including "transfer function," "frequency response," and "filter response." One HRTF could be represented as an impulse response in the time domain or as a frequency response in the frequency domain.

We may define the direction of arrival in terms of Azimuth and Elevation angles (Az, El), or in terms of an (x,y,z) unit vector. For example, in FIG. 1, the arrival direction of sound (at listener 1's ears) may be defined in terms of an (x,y,z) unit vector, where the x and y axes are as shown, and the z axis is perpendicular to the plane of FIG. 1, and the sound's arrival direction may also defined in terms of the Azimuth angle Az shown (e.g., with an Elevation angle, El, equal to zero).

FIG. 2 shows the arrival direction of sound (emitted from source position S) at location L (e.g., the location of a listener's ear), defined in terms of an (x,y,z) unit vector, where the x, y, and z axes are as shown, and in terms of Azimuth angle Az and Elevation angle, El.

It is common to make measurements of HRTFs for individuals by emitting sound from different directions, and capturing the response at the ears of the listener. Measurements may be made close to the listener's eardrum, or at the entrance of the blocked ear canal, or by other methods that are well known in the art. The measured HRTF responses may be modified in a number of ways (also well known in the art) to compensate for the equalization of the loudspeaker used in the measurements, as well as to compensate for the equalization of headphones that will be used later in presentation of the binaural material to the listener.

A typical use of HRTFs is as filter responses for signal processing intended to create the illusion of 3D sound, for a listener wearing headphones. Other typical uses for HRTFs include the creation of improved playback of audio signals through loudspeakers. For example, it is conventional to use HRTFs to implement a virtualizer which generates output audio signals (in response to input audio signals indicative of sound from a set of source locations) such that, when the output audio signals are reproduced by speakers, they are perceived as being emitted from the source locations rather than the locations of the physical speakers (where the source locations and output locations are relative to the listener). Virtualizers can be implemented in a wide variety of multimedia devices that contain stereo loudspeakers (televisions, PCs, iPod docks), or are intended for use with stereo loudspeakers or headphones.

Virtual surround sound can help create the perception that there are more sources of sound than there are physical speakers (e.g., headphones or loudspeakers). Typically, at least two speakers are required for a normal listener to perceive reproduced sound as if it is emitting from multiple sound sources. It is conventional for virtual surround systems to use HRTFs to generate audio signals that, when reproduced by physical speakers (e.g., a pair of physical speakers) positioned in front of a listener are perceived at the listener's eardrums as sound from loudspeakers at any of a wide variety of positions (including positions behind the listener).

Most or all of the conventional uses of HRTFs would benefit from embodiments of the invention.

BRIEF DESCRIPTION OF THE INVENTION

In a class of embodiments, the invention is a method for performing linear mixing on coupled HRTFs (i.e., on values which determine the coupled HRTFs) to determine an interpolated HRTF for any specified arrival direction in a range (e.g., a range spanning at least 60 degrees in a plane, or a full range of 360 degrees in a plane), where the coupled HRTFs have been predetermined to have properties such that linear mixing can be performed thereon (to generate interpolated HRTFs) without introducing significant comb filtering distortion (in the sense that each interpolated HRTF determined by such linear mixing has a magnitude response which does not exhibit significant comb filtering distortion).

Typically, the linear mixing is performed on values of a predetermined "coupled HRTF set," where the coupled HTRF set comprises values which determine a set of coupled HRTFs, each of the coupled HRTFs corresponding to one of a set of at least two arrival directions. Typically, the coupled HRTF set includes a small number of coupled HRTFs, each for a different one of a small number of arrival directions within a space (e.g., a plane, or part of a plane), and linear interpolation performed on coupled HRTFs in the set determines an HRTF for any specified arrival direction in the space. Typically, the coupled HRTF set includes a pair of coupled HRTFs (a left ear coupled HRTF and a right ear coupled HRTF) for each of a small number of arrival angles that span a space (e.g., a horizontal plane) and are quantized to a particular angular resolution. For example, the set of coupled HRTFs may consist of a coupled HRTF pair for each of twelve angles of arrival around a 360 degree circle, with an angular resolution of 30 degrees (i.e., angles of 0, 30, 60, . . . , 300, and 330 degrees).

In some embodiments, the inventive method uses (e.g., includes steps of determining and using) an HRTF basis set which in turn determines a coupled HRTF set. For example, the HRTF basis set may be determined (from predetermined coupled HRTF set) by performing a least-mean-squares fit, or another fitting process, to determine coefficients of the HRTF basis set such that the HRTF basis set determines the coupled HRTF set to within adequate (predetermined) accuracy. The HRTF basis set "determines" the coupled HRTF set in the sense that linear combination of values (e.g., coefficients) of the HRTF basis set (in response to a specified arrival direction) determines the same HRTF (to within adequate accuracy) determined by linear combination of coupled HRTFs in the coupled HRTF set in response to the same arrival direction.

The coupled HRTFs generated or employed in typical embodiments of the invention differ from normal HRTFs (e.g., physically measured HRTFs) by having significantly reduced inter-aural group delay at high frequencies (above a coupling frequency), while still providing a well-matched inter-aural phase response (compared to that provided by a pair of left ear and right ear normal HRTFs) at low frequencies (below the coupling frequency). The coupling frequency is greater than 700 Hz and typically less than 4 kHz. The coupled HRTFs of a coupled HRTF set generated (or employed) in typical embodiments of the invention are typically determined from normal HRTFs (for the same arrival directions) by intentionally altering the phase response of each normal HRTF above the coupling frequency (to produce a corresponding coupled HRTF). This is done such that the phase responses of all coupled HRTF filters in the set are coupled above the coupling frequency (i.e., so that the difference between the phase of each left ear coupled HRTF and each right ear coupled HRTF is at least substantially constant as a function of frequency, for all frequencies substantially above the coupling frequency, and preferably so that the phase response of each coupled HRTF in the set is at least substantially constant as a function of frequency for all frequencies substantially above the coupling frequency).

In typical embodiments, the inventive method includes the steps of:

(a) in response to a signal indicative of a specified arrival direction (e.g., data indicative of the specified arrival direction), performing linear mixing on data indicative of coupled HRTFs of a coupled HRTF set (where the coupled HRTF set comprises values which determine a set of coupled HRTFs, each of the coupled HRTFs corresponding to one of a set of at least two arrival directions) to determine an HRTF for the specified arrival direction; and (b) performing HRTF filtering on an audio input signal (e.g., frequency domain audio data indicative of one or more audio channels, or time domain audio data indicative of one or more audio channels), using the HRTF for the specified arrival direction. In some embodiments, step (a) includes the step of performing linear mixing on coefficients of an HRTF basis set to determine the HRTF for the specified arrival direction, where the HRTF basis set determines the coupled HRTF set.

In some embodiments, the invention is an HRTF mapper (and a mapping method implemented by such an HRTF mapper) configured to perform linear interpolation on (i.e., linear mixing of) coupled HRTFs of a coupled HRTF set, to determine an HRTF for any specified arrival direction in a range (e.g., a range spanning at least 60 degrees in a plane, or a full range of 360 degrees in a plane, or even the full range of arrival angles in three dimensions). In some embodiments, the HRTF mapper is configured to perform linear mixing of filter coefficients of an HRTF basis set (which in turn determines a coupled HRTF set) to determine an HRTF for any specified arrival direction in a range (e.g., a range spanning at least 60 degrees in a plane, or a full range of 360 degrees in a plane, or even the full range of arrival angles in three dimensions).

In a class of embodiments, the invention is a method and system for performing HRTF filtering on an audio input signal (e.g., frequency domain audio data indicative of one or more audio channels, or time domain audio data indicative of one or more audio channels). The system includes an HRTF mapper (coupled to receive a signal, e.g., data, indicative of a direction of arrival), and a HRTF filter subsystem (e.g., stage) coupled to receive the audio input signal and configured to filter the audio input signal using an HRTF determined by the HRTF mapper in response to the arrival direction. For example, the mapper may store (or be configured to access) data determining an HRTF basis set (which in turn determines a coupled HRTF set), and may be configured to perform linear combination of coefficients of the HRTF basis set in a manner determined by the arrival direction (e.g., an arrival direction, specified as an angle or as a unit-vector, corresponding to a set of input audio data asserted to the HRTF filter subsystem) to determine an HRTF pair (i.e., a left-ear HRTF and a right-ear HRTF) for the arrival direction. The HRTF filter subsystem may be configured to filter a set of input audio data asserted thereto, with an HRTF pair determined by the mapper for an arrival direction corresponding to the input audio data. In some embodiments, the HRTF filter subsystem implements a virtualizer, e.g., a virtualizer configured to process data indicative of a monophonic input audio signal to generate left and right audio output channels (for example, for presentation over headphones so as to provide a listener with an impression of sound emitted from a source at the specified arrival direction). In some embodiments, the virtualizer is configured to generate output audio (in response to input audio indicative of sound from a fixed source) indicative of sound from a source that is panned smoothly between arrival angles in a space spanned by a set of coupled HRTFs (without introducing significant comb filtering distortion).

Using a coupled HRTF set determined in accordance with a class of embodiments of the invention, input audio may be processed such that it appears to arrive from any angle in a space spanned by the coupled HRTF set, including angles which do not exactly correspond to the coupled HRTFs included in the set, without introducing significant comb filtering distortion.

Typical embodiments of the invention determine (or determine and use) a set of coupled HRTFs which satisfies the following three criteria (sometimes referred to herein for convenience as the "Golden Rule"):

1. The inter-aural phase response of each pair of HRTF filters (i.e., each left ear HRTF and right ear HRTF created for a specified arrival direction) that are created from the set of coupled HRTFs (by a process of linear mixing) match the inter-aural phase response of a corresponding pair of left ear and right ear normal HRTFs with less than 20% phase error (or more preferably, with less than 5% phase error), for all frequencies below a coupling frequency. The coupling frequency is greater than 700 Hz and is typically less than 4 kHz. In other words, the absolute value of the difference between the phase of the left ear HRTF created from the set and the phase of the corresponding right ear HRTF created from the set differs by less than 20% (or more preferably, less than 5%) from the absolute value of the difference between the phase of the corresponding left ear normal HRTF and the phase of the corresponding right ear normal HRTF, at each frequency below the coupling frequency. At frequencies above the coupling frequency, the phase response of the HRTF filters that are created from the set (by the process of linear mixing) deviate from the behavior of normal HRTFs, such that the interaural group delay (at such high frequencies) is significantly reduced compared to normal HRTFs;

2. The magnitude response of each HRTF filter created from the set (by a process of linear mixing) for an arrival direction is within the range expected for normal HRTFs for the arrival direction (e.g., in the sense that it does not exhibit significant comb filtering distortion relative to the magnitude response of a typical normal HRTF filter for the arrival direction); and 3. The range of arrival angles that can be spanned by the mixing process (to generate an HRTF pair for each arrival angle in the range by a process of linear mixing coupled HRTFs in the set) is at least 60 degrees (and preferably is 360 degrees).

An aspect of the invention is a system configured to perform any embodiment of the inventive method. In some embodiments, the inventive system is or includes a general or special purpose processor (e.g., an audio digital signal processor) programmed with software (or firmware) and/or otherwise configured to perform an embodiment of the inventive method. In some embodiments, the inventive system is implemented by appropriately configuring (e.g., by programming) a configurable audio digital signal processor (DSP). The audio DSP can be a conventional audio DSP that is configurable (e.g., programmable by appropriate software or firmware, or otherwise configurable in response to control data) to perform any of a variety of operations on input audio, as well as to perform an embodiment of the inventive method. In operation, an audio DSP that has been configured to perform an embodiment of the inventive method in accordance with the invention is coupled to receive at least one input audio signal, and at least one signal indicative of an arrival direction, and the DSP typically performs a variety of operations on each said audio signal in addition to performing HTRF filtering thereon in accordance with the embodiment of the inventive method.

Other aspects of the invention are methods for generating a set of coupled HRTFs (e.g., one which satisfies the Golden Rule described herein), a computer readable medium (e.g., a disc) which stores (in tangible form) code for programming a processor or other system to perform any embodiment of the inventive method, and a computer readable medium (e.g., a disc) which stores (in tangible form) data which determine a set of coupled HRTFs, where the set of coupled HRTFs has been determined in accordance with an embodiment of the invention (e.g., to satisfy the Golden Rule described herein).

BRIEF DESCRIPTION OF THE DRAWINGS

FIG. 5(*b*) is a plot of the phase responses (phase versus frequency) of the non-synthesized 35, 45 and 55 degree, right ear $HRTF_R$s of FIG. 3.

FIG. 6(*b*) is a plot of the phase responses of right ear, coupled HRTFs (generated in accordance with another embodiment of the invention) for 35 and 55 degree Azimuth angles.

FIG. 7 is a plot of the frequency response (magnitude versus frequency) of a conventionally determined right ear HRTF for 45 degree Azimuth angle (labeled $HRTF_R(45,0)$), and a plot of the frequency response of a right ear HRTF (labeled $(HRTF^Z_R(35, 0)+HRTF^Z_R(55, 0)/2)$ determined in accordance with an embodiment of the invention by linearly mixing coupled HRTFs (also determined in accordance with the invention) for 35 and 55 degree Azimuth angles.

FIG. 8 is a graph (plotting magnitude versus frequency, with frequency expressed in units of FFT bin index k) of a weighting function, W(k), employed in some embodiments of the invention to determine coupled HRTFs.

FIG. 9 is a block diagram of an embodiment of the inventive system

DETAILED DESCRIPTION OF THE PREFERRED EMBODIMENTS

Figure 1:
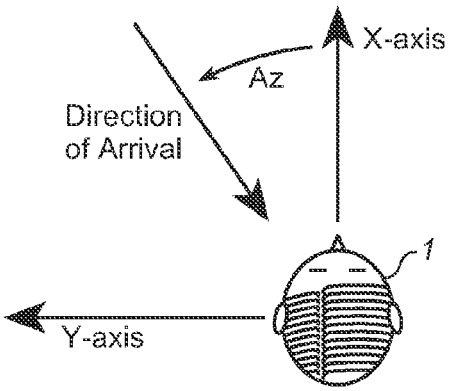
FIG. 1 is a diagram showing the definition of an arrival direction of sound (at listener 1's ears) in terms of an (x,y,z) unit vector, where the z axis is perpendicular to the plane of FIG. 1, and in terms of Azimuth angle Az (with an Elevation angle, El, equal to zero).
Figure 2:
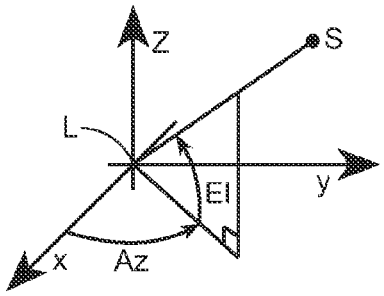
FIG. 2 is a diagram showing the definition of an arrival direction of sound (emitted from source position S) at location L, in terms of an (x,y,z) unit vector, and in terms of Azimuth angle Az and Elevation angle, El.

Many embodiments of the present invention are technologically possible. It will be apparent to those of ordinary skill in the art from the present disclosure how to implement them. Embodiments of the inventive system, medium, and method will be described with reference to FIGS. 3-13.

Herein, a "set" of HRTFs denotes a collection of HRTFs that correspond to multiple directions of arrival. A look-up table may store a set of HRTFs, and may output (in response to input indicative of an arrival direction) a pair of left-ear and right-ear HRTFs (included in the set) that corresponds to the arrival direction. Typically, a left-ear HRTF and a right-ear HRTF (corresponding to each direction of arrival) are included in a set.

Left-ear and right-ear HRTFs implemented as finite length impulse responses (which is the manner in which they are most commonly implemented) will sometimes be referred to herein as: $HRTF_L$ (x, y, z, n) and $HRTF_R$(x, y, z, n), respectively, where (x,y,z) identifies the unit-vector that defines the corresponding direction of arrival (alternatively, HRTFs are defined with reference to Azimuth and Elevation angles, Az and El, instead of position coordinates x, y and z, in some embodiments of the invention), and where $0 \le n \le N$, where N is the order of the FIR filters, and n is the impulse response sample number. Sometimes, for simplicity, we will refer to such filters without reference to the impulse response samples that comprise them (e.g., the filters will be referred to as HRTF, (x,y,z) or HRTF, (Az, El)), when no confusion arises from the omission of reference to the impulse response sample number, n.

Herein, the expression "normal HRTF" denotes a filter response that closely resembles the Head Related Transfer Function of a real human subject. A normal HRTF may be created by any of a variety of methods well known the art. An aspect of the present invention is a new type of HRTF (referred to herein as a coupled HRTF) that differs from normal HRTFs in specific ways to be described.

Herein, the expression "HRTF basis set" denotes a collection of filter responses (generally FIR filter coefficients) that may be linearly combined together to generate HRTFs (HRTF coefficients) for various directions of arrival. Many methods are known in the art for producing reduced-size sets of filter coefficients, including the method that is commonly referred to as principal component analysis.

Herein the expression "HRTF mapper" denotes a method or system which determines a pair of HRTF impulse responses (a left-ear response and a right-ear response) in response to a specified direction of arrival (e.g., a direction specified as an angle or as a unit-vector). An HRTF mapper may operate by using a set of HRTFs, and may determine the HRTF pair for the specified direction by choosing the HRTF in the set whose corresponding arrival direction is closest to the specified arrival direction. Alternatively, an HRTF mapper may determine each HRTF for the requested direction by interpolating between HRTFs in the set, where the interpolation is between HRTFs in the set having corresponding arrival directions close to the requested direction. Both of these techniques (nearest match, and interpolation) are well known in the art.

For example, an HRTF set may contain a collection of impulse response coefficients that represent HRTFs for multiple directions of arrival, including a number of directions in the horizontal plane (El=0). If the set includes entries for (Az=35°, El=0°) and (Az=55°, El=0°), then an HRTF mapper could produce an estimated HRTF response for) (Az=45°,El=0° by some form of mixture:

$$HRTF_L(45,0)=mix(HRTF_L(35,0),HRTF_L(55,0))$$

$$HRTF_R(45,0)=mix(HRTF_R(35,0),HRTF_R(55,0)) \quad (1.1)$$

Alternatively, an HRTF mapper may produce the HRTF filters for a particular angle of arrival by linearly mixing together filter coefficients from an HRTF basis set. A more detailed exposition of this example is given in the description below regarding B-format coupled HRTFs.

It is tempting to perform each mix operation of equations (1.1) by simple averaging of the impulse responses, e.g., as follows:

$$HRTF_L(45, 0, n) = \frac{HRTF_L(35, 0, n) + HRTF_L(55, 0, n)}{2} \quad (1.2)$$

$$HRTF_R(45, 0, n) = \frac{HRTF_R(35, 0, n) + HRTF_R(55, 0, n)}{2}$$

However, the simple linear interpolation approach to mixing (e.g., as in equations (1.2)) of conventionally generated HRTFs leads to problems due to the existence of significant group-delay differences between the responses that are mixed (e.g., conventionally determined responses $HRTF_R$(35,0) and $HRTF_R$(55,0) in equations (1.2)).

Figure 3:
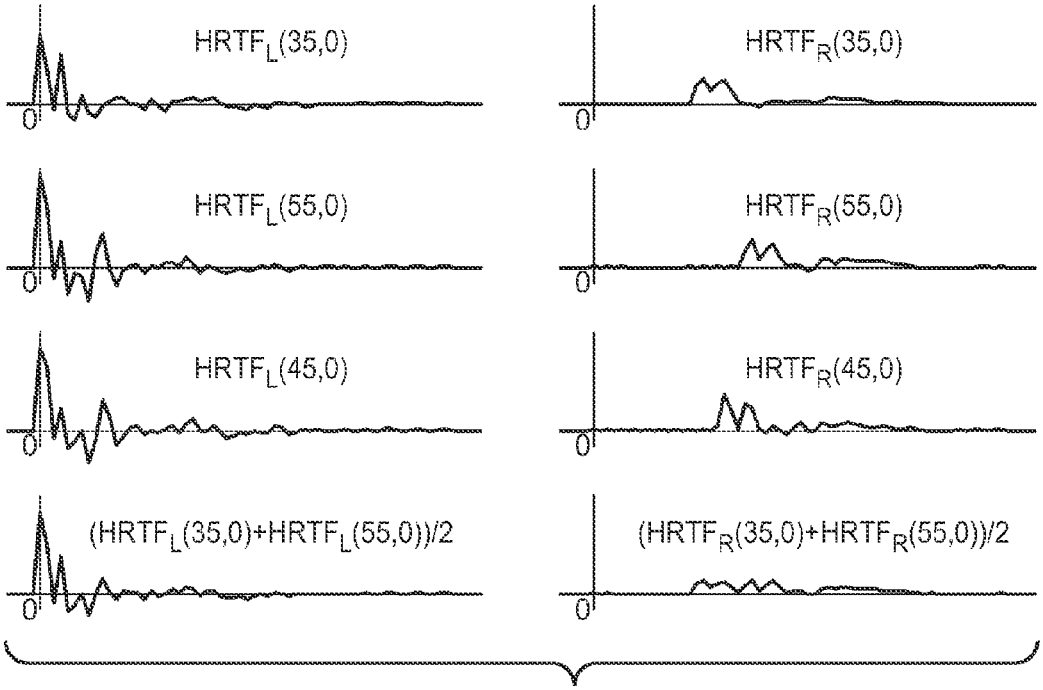
FIG. 3 is a set of plots (magnitude versus time) of pairs of conventionally determined HRTF impulse responses for 35 and 55 degree Azimuth angles (labeled $HRTF_L(35,0)$ and $HRTF_R(35,0)$, and $HRTF_L(55,0)$ and $HRTF_R(55,0)$), a pair of conventionally determined (measured) HRTF impulse responses for 45 degree Azimuth angle (labeled $HRTF_L(45,0)$ and $HRTF_R(45,0)$, and a pair of synthesized HRTF impulse responses for 45 degree Azimuth angle (labeled $(HRTF_L(35,0)+HRTF_L(55,0))/2$ and $(HRTF_R(35,0)+HRTF_R(55,0))/2$) generated by linearly mixing the conventional HRTF impulse responses for 35 and 55 degree Azimuth angles.
Figure 4:
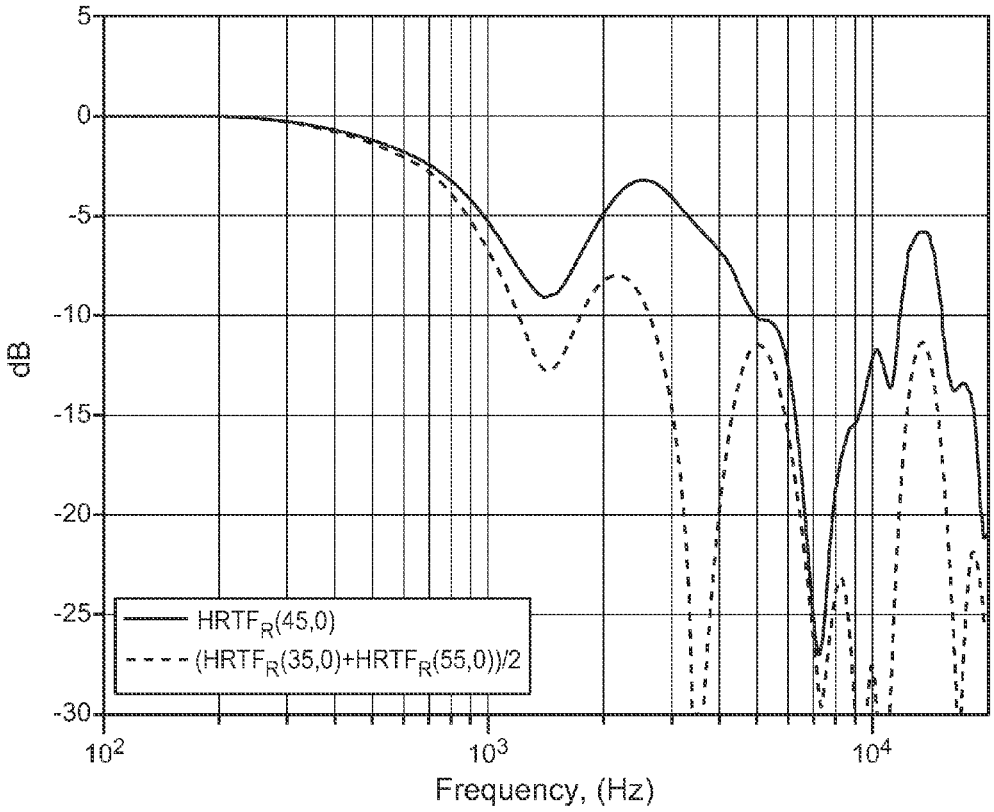
FIG. 4 is a graph of the frequency response of the synthesized right ear HRTF ($(HRTF_R(35,0)+HRTF_R(55,0))/2$) of FIG. 3, and the frequency response of the true right ear HRTF for 45 degree Azimuth ($HRTF_R(45,0)$) of FIG. 3.

FIG. 3 shows typical normal HRTF impulse responses for 35 and 55 degree Azimuth angles (the responses labeled $HRTF_L$(35,0) and $HRTF_R$(35,0), and the responses labeled $HRTF_L$(55,0) and $HRTF_R$(55,0) in FIG. 3), along with a pair of true (measured) 45 degree Azimuth HRTFs (labeled $HRTF_L$(45,0) and $HRTF_R$(45,0) in FIG. 3). FIG. 3 also shows a pair of synthesized 45 degree HRTFs (labeled ($HRTF_L$(35,0)+$HRTF_L$(55,0))/2 and ($HRTF_R$(35,0)+$HRTF_R$(55,0))/2 in FIG. 3), generated by averaging the 35 and 55 degree responses in the manner shown in equations (1.2). FIG. 4 shows the frequency response of the averaged ("($HRTF_R$(35,0)+$HRTF_R$(55,0))/2") versus the true ("$HRTF_R$(45,0)") right-ear HRTF for the 45 degree Azimuth angle.

Figure 5A:
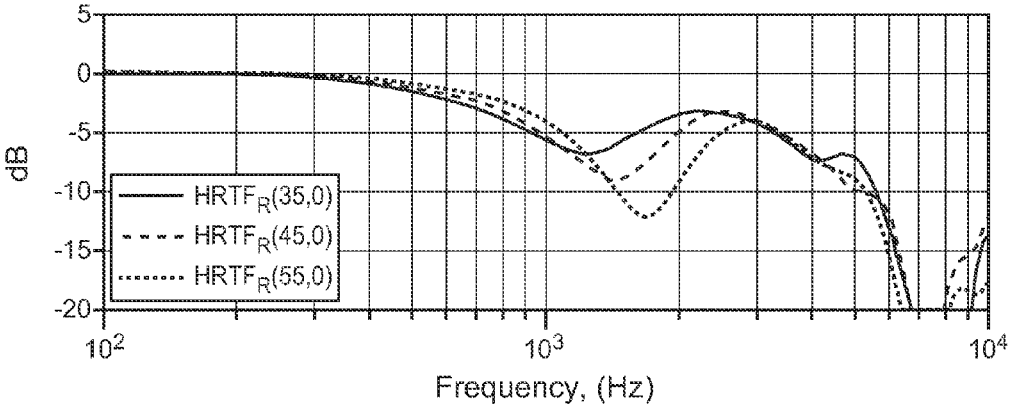
FIG. 5(*a*) is a plot of the frequency responses (magnitude versus frequency) of the non-synthesized 35, 45 and 55 degree, right ear $HRTF_R$s of FIG. 3.
Figure 5B:
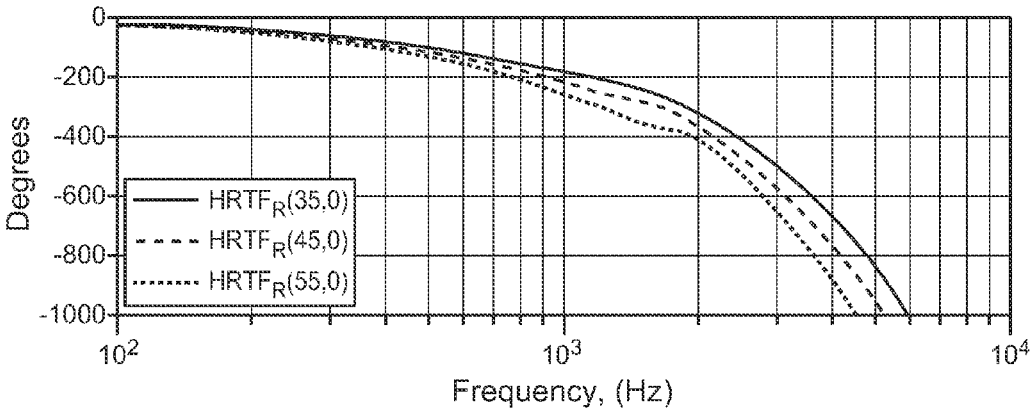

In FIG. 5(*a*), the frequency responses (magnitude versus frequency) of the true 35, 45 and 55 degree $HRTF_R$ filters (of FIG. 3) are plotted. In FIG. 5(*b*), the phase responses (phase versus frequency) of the true 35, 45 and 55 degree $HRTF_R$ filters (of FIG. 3) are plotted.

As is apparent from FIG. 3, the $HRTF_R$(35,0) and $HRTF_R$(55,0) impulse responses show significantly different delays (as indicated by the sequence of near-zero coefficients at the start of each of these impulse responses). These onset delays are caused by the time taken for sound to propagate to the more distant ear (since the 35, 45 and 55 degree azimuth angles imply that the sound reaches the left ear first, and hence there will be a delay to the right ear, and this delay will increase as azimuth increases from 35 to 55 degrees). It is also apparent from FIG. 3 that the $HRTF_R$(45,0) response has an onset delay that is somewhere between the delays of the 35 and 55 degree responses (as would be expected). However, the response created by averaging the 35 and 55 degree impulse responses appears to be very dissimilar to the true 45 degree impulse response ($HRTF_R$(45,0)). This difference, which is quite noticeable in the impulse response plots of FIG. 3, is even more evident in the frequency response plots of FIG. 4.

For example, there is a deep notch apparent in FIG. 4 at about 3.5 kHz in the filter response that was created by averaging the 35 and 55 degree HRTFs. The "correct" 45 degree HRTF (labeled "$HRTF_R$(45,0)" in FIG. 4) does not have a notch at about 3.5 kHz. Thus, it is apparent that the mixing operation performed to generate the averaged response "($HRTF_R$ (35,0)+$HRTF_R$(55,0))/2" undesirably introduced the notch, which is an example of artifact introduction commonly referred to as "comb filtering." Note that notches (comb filtering artifacts) also appear in FIG. 4 in the synthesized filter response (created by averaging the 35 and 55 degree HRTFs), at 10 kHz and 17 kHz.

The cause of this comb filtering (combing) may be observed by examining the phase response of the $HRTF_R$ filters, as shown in FIG. 5(*b*). It is evident from FIG. 5(*b*) that, at 3.5 kHz, the 35-degree HRTF for the right ear has a 600 degree phase shift, whereas the 55 degree HRTF for the right ear has a 780 degree phase shift. The 180-degree phase difference between the 35 and 55 degree filters means that any summation of these filters (as would occur when they are averaged), will result in partial cancellation of the response at 3.5 kHz (and hence the deep notch shown in FIG. 4).

While it would be desirable to use linear-interpolation techniques (such as the averaging method described above) to implement an HRTF mapper, comb filtering (notching) problems of the type described present a significant difficulty, because the resulting notches will result in audible artifacts in the HRTFs produced such an HRTF mapper. If the spatial resolution of the HRTF-set is increased (e.g., by using a larger set, with measurements made on a finer-scale grid), the notching problems will typically still be present (but the notches in the interpolated response may appear at higher frequencies).

In a class of embodiments, the present invention is an HRTF mapper that can determine a pair of HRTFs ($HRTF_L$ and $HRTF_R$) for an arbitrary direction of arrival, by forming a weighted sum of HRTFs of a small library (set) of specially generated HRTFs (e.g., a set of less than 50 HRTFs). If the set contains L entries (d=1, . . . , L), the mapper can compute:

$$HRTF_L(x, y, z, n) = \sum_{d=1}^{L} WL_d^{x,y,z} \times IR_d(n) \quad (1.3)$$

$$HRTF_R(x, y, z, n) = \sum_{d=1}^{L} WR_d^{x,y,z} \times IR_d(n)$$

where the WL and WR values are sets of weighting coefficients (each for a specific arrival direction, determined by x, y, and z, and set index, d), and the $IR_d$(n) coefficients are the impulse responses in the set.

The specially generated HRTFs (referred to herein as "coupled HRTFs" or "coupled HRTF filters") in the inventive set of HRTFs (referred to herein as a "coupled HRTF set") are artificially created (e.g., by modifying "normal" HRTFs) so that the responses in the set can be linearly mixed as per equations (1.3) to produce HRTFs for arbitrary directions of arrival. The set of coupled HRTFs typically includes a pair of coupled HRTFs (a left ear HRTF and a right ear HRTF) for each of a number of arrival angles that span a given space (e.g., a horizontal plane) and are quantized to a particular angular resolution (e.g., a set of coupled HRTFs represents angles of arrival with an angular resolution of 30 degrees around a 360 degree circle: 0, 30, 60, . . . , 300, and 330 degrees). The coupled HRTFs in the set are determined such that they differ from "normal" (true, e.g., measured) HRTFs for the angles of arrival of the set. Specifically, they differ in that the phase response of each normal HRTF is intentionally altered above a specific coupling frequency (to produce a corresponding coupled HRTF). More specifically, the phase response of each normal HRTF is intentionally altered such that the phase responses of all coupled HRTF filters in the set are coupled above the coupling frequency (i.e., so that the inter-aural phase difference, between the phase of each left ear coupled HRTF and each right ear coupled HRTF, is at least substantially constant as a function of frequency for all frequencies substantially above the coupling frequency, and preferably so that the phase response of each coupled HRTF in the set is at least substantially constant as a function of frequency for all frequencies substantially above the coupling frequency).

The creation of the coupled HRTF sets makes use of the Duplex Theory of Sound Localization, proposed by Lord Rayleigh. The Duplex Theory asserts that time-delay differences in HRTFs provide important cues for human listeners at lower frequencies (up to a frequency in the range from about 1000 Hz to about 1500 Hz), and that amplitude differences provide important cues for human listeners at higher frequencies. The Duplex Theory does not imply that the phase or delay properties of HRTFs at higher frequencies are totally unimportant, but simply says that they are of relatively lower importance, with amplitude differences being more important at high frequencies.

To determine a coupled HRTF set, one begins by selecting a "coupling frequency" ($F_C$), which is the frequency below which each pair of the coupled HRTFs for an arrival direction (i.e., left and right ear coupled HRTFs for the arrival direction) have an inter-aural phase response (the relative phase between the left and right ear filters, as a function of frequency) which closely matches the inter-aural phase response of corresponding left and right "normal" HRTFs for the same arrival direction. In preferred embodiments, the inter-aural phase responses match closely in the sense that the phase of each coupled HRTF is within 20% (or more preferably, within 5%) of the phase of the corresponding "normal" HRTF, for frequencies below the coupling frequency.

Figure 6A:
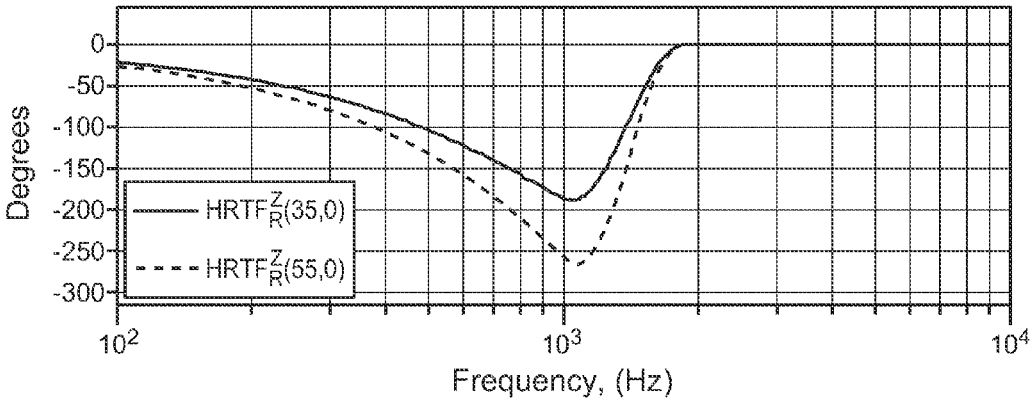
FIG. 6(*a*) is a plot of the phase responses of right ear, coupled HRTFs (generated in accordance with an embodiment of the invention) for 35 and 55 degree Azimuth angles.
Figure 6B:
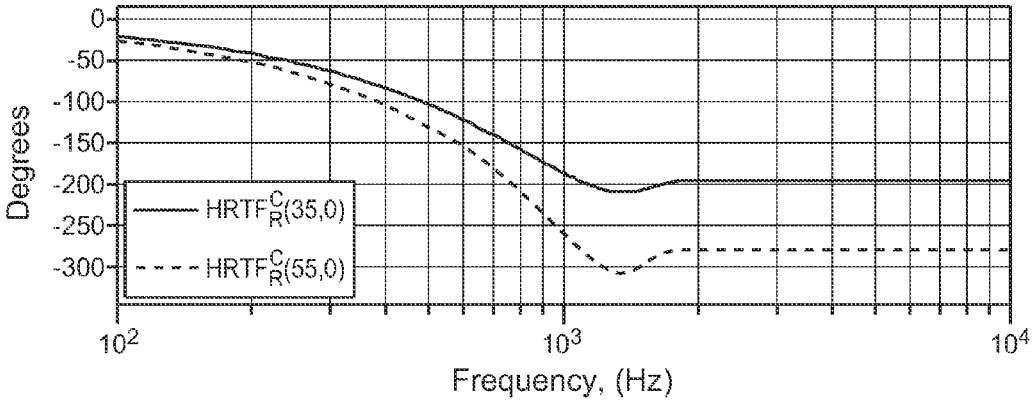

To appreciate the concept of the noted "close match" between inter-aural phase responses, consider the phase responses of 35 and 55 degree coupled $HRTF_R$s ($HRTF^Z_R$(35, 0), $HRTF^Z_R$(55, 0), $HRTF^C_R$(35, 0), and $HRTF^C_R$(55, 0)), as shown in FIGS. 6(*a*) and 6(*b*). The magnitude responses of these coupled HRTFs (not plotted in FIGS. 6(*a*) and 6(*b*) are the same as those of corresponding "normal" HRTFs (i.e., $HRTF_R$(35, 0) and $HRTF_R$(55, 0) of FIGS. 5(*a*) and 5(*b*)) from which they were determined (so the magnitude responses are the same as those plotted in FIG. 5(*a*)). To determine each of the coupled $HRTF_R$s from a corresponding normal HRTF, only the phase response is altered (relative to that of the corresponding normal HRFT), and only above the coupling frequency (which is $F_C$=1000 Hz, in the example). The result of this phase-response modification is to allow the coupled HRTFs to be linearly mixed together without causing undesirable comb filter artifacts (in the sense that each interpolated HRTF determined by such linear mixing has a magnitude response which does not exhibit significant comb filtering distortion).

Thus, the phase response of $HRTF^Z_R$(35, 0) of FIG. 6(*a*) closely matches that of normal $HRTF_R$(35, 0) of FIG. 5(*b*) below the coupling frequency ($F_C$=1000 Hz), that of $HRTF^Z_R$(55, 0) of FIG. 6(*a*) closely matches that of normal $HRTF_R$(55, 0) of FIG. 5(*b*) below the coupling frequency ($F_C$=1000 Hz), that of $HRTF^C_R$(35, 0) of FIG. 6(*b*) closely matches that of normal $HRTF_R$(35, 0) of FIG. 5(*b*) below the coupling frequency ($F_C$=1000 Hz), and that of $HRTF^C_R$(55, 0) of FIG. 6(*b*) closely matches that of normal $HRTF_R$(35, 0) of FIG. 5(*b*) below the coupling frequency ($F_C$=1000 Hz). The phase responses of $HRTF^Z_R$(35, 0) and $HRTF^Z_R$(55, 0) of FIG. 6(*a*) differ substantially from those of normal $HRTF_R$(35, 0) and normal $HRTF_R$(55, 0) of FIG. 5(*b*) above the coupling frequency, and the phase responses of $HRTF^C_R$(35, 0) and $HRTF^C_R$(55, 0) of FIG. 6(*b*) differ substantially from those of normal $HRTF_R$(35, 0) and normal $HRTF_R$(55, 0) of FIG. 5(*b*) above the coupling frequency.

The phase responses of $HRTF^Z_R$(35, 0) and $HRTF^Z_R$(55, 0) of FIG. 6(*a*) are coupled at frequencies above the coupling frequency (so that the inter-aural phase responses determined from them and corresponding left ear $HRTF^Z_L$(35, 0) and $HRTF^Z_L$(55, 0), would match or nearly match at frequencies substantially above the coupling frequency). Similarly, the phase responses of $HRTF^C_R$(35, 0) and $HRTF^C_R$(55, 0) of FIG. 6(*b*) are coupled at frequencies above the coupling frequency (so that the inter-aural phase responses determined from them and corresponding left ear $HRTF^C_L$(35, 0) and $HRTF^C_L$(55, 0), would match or nearly match at frequencies substantially above the coupling frequency). As shown in FIG. 6(*b*), the phase responses plotted for $HRTF^C_R$(35, 0) and $HRTF^C_R$(55, 0) do not deviate from each other by more than about 90 degrees, and we consider this to be close "matching" of the phase responses, since this matching ensures that these coupled filters can be linearly mixed together without causing significant combing.

FIG. 7 is a plot of the frequency response (magnitude versus frequency) of conventionally determined (normal) right ear $HRTF_R$(45,0) of FIG. 5(*b*), and a plot of the frequency response of a right ear HRTF (labeled ($HRTF^Z_R$(35, 0)+$HRTF^Z_R$(55, 0)/2) determined in accordance with an embodiment of the invention by linearly mixing $HRTF^Z_R$(35, 0) and $HRTF^Z_R$(55, 0) of FIG. 6(*a*). The linear mixing is performed by adding $HRTF^Z_R$(35, 0) and $HRTF^Z_R$(55, 0), and dividing the sum by 2. As is apparent from FIG. 7, the inventive right ear HRTF ($HRTF^Z_R$(35, 0)+$HRTF^Z_R$(55, 0)/2) lacks comb filter artifacts.

In FIG. 6(*a*), the $HRTF_R{}^Z$ (35,0) and $HRTF_R{}^Z$ (55,0) phase plots show the "zero-extended" phase response of these coupled HRTFs. Similarly, FIG. 6(*b*) shows the phase of the $HRTF_R{}^C$ (35,0) and $HRTF_R{}^C$ (55,0) filters, with the phase (above the lkHz coupling frequency) being modified to smoothly crossfade to a constant phase (at frequencies substantially above the coupling frequency).

Coupled HRTFs may be created in accordance with the invention by a variety of methods. One preferred method works by taking a normal HRTF pair (i.e. left/right-ear HRTFs measured from a dummy head or a real subject, or created from any conventional method for generating suitable HRTFs), and modifying the phase response of the normal HRTFs at high frequencies (above the Coupling frequency).

We next describe examples of methods for determining a pair of left ear and right ear coupled HRTFs, from a pair of normal left ear and right ear HRTFs in accordance with the invention.

In implementing these exemplary methods, modification of the Phase response of the normal HRTFs may be accomplished by using a frequency-domain weighting function (sometimes referred to as a weighting vector), W(k), where k is an index indicating frequency (e.g., an FFT bin index), which operates on the phase response of each original (normal) HRTF. The weighting function W(k) should be a smooth curve, for example of the type shown in FIG. 8. In the typical case that the normal HRTFs are operated on using a Fast Fourier Transform (FFT) of length K, the FFT bin index k corresponds to frequency: $f=k\times F_S/K$, where $F_S$ is the sampling frequency of the digital signal. In the FIG. 8 example of the weighting function, if the frequency bin indices $k_1$ and $k_2$ correspond to frequencies of 1 kHz and 2 kHz, the coupling frequency, $F_C$, is $F_C$=1 kHz, and $k_1 \sim 1000\times K/F_S$, and $k_2 \approx 2000\times IC/F_S$.

In a class of embodiments of the inventive method for determining the coupled HRTFs (i.e., a pair of left ear and right ear coupled HRTFs for each arrival direction in a set of arrival directions) of a coupled HRTF set in response to normal HRTFs (i.e., a pair of left ear and right ear normal HRTFs for each of the arrival directions in the set), the method includes the following steps:

1. Using a Fast Fourier Transform of length K, convert each pair of normal HRTFs, $HRTF_L$ (x, y, z, n) and $HRTF_R$ (x, y, z, n), into a pair of frequency responses, $FR_L(k)$ and $FR_R(k)$, where k is the integer index of the frequency bins, centered at frequency $$f = \frac{k \times F_s}{K}$$

(where $-N/2 \le k \le N/2$, and where $F_s$ is the sampling rate);

2. then, determine magnitude and phase components ($M_L$, $M_R$, $P_L$, $P_R$), so that $FR_L(k)=M_L(k)e^{jP_L(k)}$ and $FR_R(k)=M_R(k)e^{jP_R(k)}$, and where the phase components ($P_L$,$P_R$) are unwrapped (so that any discontinuities of greater than π are removed by the addition of integer multiples of 2π to the samples of the vector, e.g., using the conventional Matlab "unwrap" function);

3. If the normal HRTF pair corresponds to an arrival direction that lies in the left hemisphere (so that y>0), then perform the following steps to compute $FR'_L$ and $FR'_R$:

(a) compute the modified Phase vector: $P'(k)=(P_R(k)-P_L(k))\times W(k)$, where W(k) is the weighting function defined above; and (b) then, compute $FR'_L$ and $FR'_R$ as follows:

$$FR'_L(k)=M_L(k)e^{jP_L(k)}$$

$$FR'_R(k)=M_R(k)e^{j(P_L(k)+P'(k))};$$

4. If the normal HRTF pair corresponds to an arrival direction that lies in the right hemisphere (so that y<0), then perform the steps of:

(a) compute the modified Phase vector: $P'(k)=(P_L(k)-P_R(k))\times W(k)$; and (b) then, compute $FR'_L$ and $FR'_R$ as follows:

$$FR'_L(k)=M_L(k)e^{j(P_R(k)+P'(k))}$$

$$FR'_R(k)=M_R(k)e^{jP_R(k)};$$

5. If the normal HRTF pair corresponds to an arrival direction that lies in the medial plane (so that y=0), then there is no need to alter the phase of the far-ear response, so we simply compute:

$$FR'_L(k)=M_L(k)e^{jP_L(k)}$$

$$FR'_R(k)=M_R(k)e^{jP_R(k)};\text{ and}$$

6. finally, use the inverse Fourier transform to compute the coupled HRTFs (and add an extra bulk delay of g samples to both coupled HRTFs) as follows:

$$HRTF_L^Z(x,y,z,n)=IFFT\{FR'_L(k)\times e^{-2\pi jgk/K}\}$$

$$HRTF_R^Z(x,y,z,n)=IFFT\{FR'_R(k)\times e^{-2\pi jgk/K}\}.$$

The modification that is made to the phase response in step 3 (or step 4) will often result in some time-smearing of the final impulse responses, so that an HRTF FIR filter that was originally causal may be transformed into an a-causal FIR filter. To guard against this time-smearing, an added bulk delay may be needed in both the left and right ear coupled HRTF filters, as implemented in step 6. A typical value of g would be g=48.

The process described above with reference to steps 1-6 must be repeated for each pair of the normal $HRTF_L$ and $HRTF_R$ filters, to produce each coupled $HRTF^Z_L$ filter and each coupled $HRTF^Z_R$ filter in the coupled HRTF set. Variations may be made to the described process.

For example, step 3(b) above shows the original Left channel phase response being preserved, while the right channel response is generated by using the Left phase plus the modified Right-Left phase difference. As an alternative, the equations in step 3(b) could be modified to read:

$$FR'_L(k)=M_L(k)$$

$$FR'_R(k)=M_R(k)e^{jP'(k)}. \tag{1.4}$$

In this case, the Phase response of the original left-ear HRTF is completely disregarded, and the new right-ear HRTF is imparted with the modified Right-Left phase difference.

Yet another variation on the described method involves the phase shifting of both left and right ear HRTFs (with opposite phase shifts):

$$FR'_L(k)=M_L(k)e^{-jP'(k)/2}$$

$$FR'_R(k)=M_R(k)e^{jP'(k)/2}. \tag{1.5}$$

Of course, if the alternative equations (1.4 or 1.5) are substituted in step 3(b) above, then corresponding complementary equations should be applied in step 4(b) (to allow for the case where the HRTF direction-of-arrival is in the right hemisphere).

The symmetry implied by equations (1.5) is employed in another class of embodiments of the inventive method for determining the coupled HRTFs (i.e., a pair of left ear and right ear coupled HRTFs for each arrival direction in a set of arrival directions) of a coupled HRTF set in response to normal HRTFs (i.e., a pair of left ear and right ear normal HRTFs for each of the arrival directions in the set). In these embodiments, the method includes the following steps:

1. Using a Fast Fourier Transform of length K, convert each pair of normal HRTFs, $HRTF_L$ (x, y, z, n) and $HRTF_R$ (x, y, z, n), into a pair of frequency responses, $FR_L(k)$ and $FR_R(k)$, where k is the integer index of the frequency bins, centered at frequency $$f = \frac{k \times F_s}{K}$$

(where $-N/2 \le k \le N/2$, and where $F_S$ is the sampling rate);

2. then, determine magnitude and phase components ($M_L$, $M_R$, $P_L$, $P_R$), so that $FR_L(k)=M_L(k)e^{jP_L(k)}$ and $FR_R(k)=M_R(k)e^{jP_R(k)}$, and where the phase components ($P_L$,$P_R$) are "unwrapped" (so that any discontinuities of greater than $\pi$ are removed by the addition of integer multiples of $2\pi$ to the samples of the vector, e.g., using the conventional Matlab "unwrap" function);

3. compute the modified Phase vector: $P'(k)=(P_R(k)-P_L(k))\times W(k)$;

4. then, compute $FR'_L$ and $FR'_R$ as follows:

$$FR'_L(k)=M(k)e^{-jP'(k)/2}$$

$$FR'_R(k)=M_R(k)e^{jP'(k)/2}; \text{ and}$$

5. finally, use the inverse Fourier transform to compute the coupled HRTFs (and add an extra bulk delay of g samples to both coupled HRTFs):

$$HRTF^Z(x,y,z,n)=IFFT\{FR'_L(k)\times e^{-2\pi jgk/K}\}$$

$$HRTF_R^Z(x,y,z,n)=IFFT\{FR'_R(k)\times e^{-2\pi jgk/K}\}.$$

An alternative method (sometimes referred to herein as a "constant-phase extension method") may be implemented with the following step (step 3a) performed instead of the above step 3:

3a. compute the modified Phase vector: $P'(k)=(P_R(k)-P_L(k))\times W(k)+(P_R(k_1)-P_L(k_1))\times(1-W(k))$.

The modified equation, set forth in substitute step 3a, has the effect of forcing the phase (P'(k)) at high frequencies to be equal to the phase at the coupling frequency, as shown in the example of FIG. 6(*b*).

We next describe another class of embodiments of the invention in which a coupled HRTF set is determined by an HRTF basis set.

A typical HRTF set (e.g., a coupled HRTF set) consists of a collection of impulse response pairs (left and right ear HRTFs), where each pair corresponds to a particular direction of arrival. In this case, the job of an HRTF mapper is to take a specified arrival direction (e.g., determined by direction-of-arrival vector, (x,y,z)) and determine an $HRTF_L$ and $HRTF_R$ filter pair corresponding to the specified arrival direction, by finding HRTFs in an HRTF set (e.g., a coupled HRTF set) that are close to the specified arrival direction, and performing some interpolation on HRTFs in the set.

If the HRTF set has been generated in accordance with the invention to comprise coupled HRTFs (such coupled HRTFs are "coupled" at high frequencies as described above), then the interpolation can be linear interpolation. Since linear interpolation (linear mixing) is used, this implies that the coupled HRTF set can be determined by an HRTF basis set. One preferred HRTF basis set of interest is the spherical harmonic basis (sometimes referred to as B-format).

The well known process of a least-mean-squares fit (or another fitting process) can be used to represent a coupled HRTF set in terms of an HRTF basis set, based on spherical harmonics. By way of example, a first-degree spherical-harmonic basis set ($H_W$, $H_X$, $H_y$, and $H_z$) may be determined so that any left ear (or right ear) HRTF (for any specific arrival direction, x, y, z, or any specific arrival direction x, y, z, in a range spanning at least 60 degrees) may be generated as:

$$HRTF_L(x,y,z,n)=H_W(n)+xH_X(n)+yH_Y(n)+zH_Z(n)$$

$$HRTF_R(x,y,z,n)=H_W(n)+xH_X(n)-yH_Y(n)+zH_Z(n) \quad (1.6)$$

where the four sets of FIR filter coefficients ($H_W$, $H_X$, $H_Y$, $H_Z$) of the HRTF basis set are determined to provide a least-mean squares best fit to a set of coupled HRTFs. By implementing equations (1.6), a table of coefficients of four FIR filters ($H_W$, $H_X$, $H_Y$, $H_Z$) suffices to determine a left ear (and right ear) HRTF for any specified arrival direction, and thus the four FIR filters ($H_W$, $H_X$, $H_Y$, $H_Z$) determine a coupled HRTF set.

A higher degree spherical harmonic representation will provide added accuracy. For example, a second degree representation of an HRTF basis set ($H_W$, $H_X$, $H_Y$, $H_z$, $H_{X2}$, $H_{Y2}$, $H_{z2}$, $H_{XY}$, $H_{YZ}$) may be defined so that any left ear (or right ear) HRTF (for a specific arrival direction x, y, z, or any specific arrival direction x, y, z, in a range spanning at least 60 degrees) may be generated as:

$$HRTF_L(x,y,z,n)=H_W(n)+xH_X(n)+yH_Y(n)+zH_Z(n)+(x^2-y^2)H_{X2}(n)+2xyH_{Y2}(n)+2xzH_{XZ}(n)+2yzH_{YZ}(n)+(2z^2-x^2-y^2)H_{Z2}(n)$$

$$HRTF_R(x,y,z,n)=H_W(n)+xH_X(n)-yH_Y(n)+zH_Z(n)+(x^2-y^2)H_{X2}(n)-2xyH_{Y2}(n)+2xzH_{XZ}(n)-2yzH_{YZ}(n)+(2z^2-x^2-y^2)H_{Z2}(n) \quad (1.7)$$

where the nine sets of FIR filter coefficients ($H_W$, $H_X$, $H_Y$, $H_Z$, $H_{X2}$, $H_{Y2}$, $H_{XZ}$, $H_{YZ}$, $H_{Z2}$) of the HRTF basis set are determined to provide a least-mean squares best fit to a set of coupled HRTFs. By implementing equations (1.7), a table of coefficients of the nine FIR filters suffices to determine a left ear (and right ear) HRTF for any specified arrival direction, and thus the nine FIR filters determine a coupled HRTF set.

Simplified equations will result if the arrival angles are limited to the horizontal plane (as may be commonly desired). In this case, all of the z-components of the spherical harmonic set may be discarded, so that the $2^{nd}$ degree equations (equations 1.7) are simplified to become:

$$HRTF_L(x,y,z,n)=H_W(n)+xH_X(n)+yH_Y(n)+(x^2-y^2)H_{X2}(n)+2xyH_{Y2}(n)$$

$$HRTF_R(x,y,z,n)=H_W(n)+xH_X(n)yH_Y(n)+(x^2-y^2)H_{X2}(n)-2xyH_{Y2}(n) \quad (1.8)$$

Equations 1.8 may alternatively be written in terms of the Azimuth angle, Az, as follows:

$$HRTF(Az,n)=H_W(n)+\cos(Az)H_X(n)+\sin(Az)H_Y(n)+\cos(2Az)H_{X2}(n)+\mathrm{Sin}(2Az)H_{Y2}(n)$$

$$HRTF_R(Az,n)=H_W(n)+\cos(Az)H_X(n)-\sin(Az)H_Y(n)+\cos(2Az)H_{X2}(n)-\mathrm{Sin}(2Az)H_{Y2}(n) \quad (1.9)$$

In a preferred embodiment, a third-order horizontal HRTF mapper operates using a third degree representation of a basis set defined so that any left ear (or right ear) HRTF for any specific arrival direction is generated as:

$$HRTF_L(Az,n) = H_W(n) + \cos(Az)H_X(n) + \sin(Az)H_Y(n) + \cos(2Az)H_{X2}(n) + \sin(2Az)H_{Y2}(n) + \cos(3Az)H_{X3}(n) + \sin(3Az)H_{Y3}(n) \quad (1.10)$$

$$HRTF_R(Az,n) = H_W(n) + \cos(Az)H_X(n) - \sin(Az)H_Y(n) + \cos(2Az)H_{X2}(n) - \sin(2Az)H_{Y2}(n) + \cos(3Az)H_{X3}(n) - \sin(3Az)H_{Y3}(n)$$

where the seven sets of FIR filter coefficients ($H_W$, $H_X$, $H_Y$, $H_{X2}$, $H_{Y2}$, $H_{X3}$, and $H_{Y3}$) of the HRTF basis set are determined to provide a least-mean squares best fit to a set of coupled HRTFs. Thus, the seven FIR filters determine a coupled HRTF set. An HRTF mapper which employs an HRTF basis set defined in this way is a preferred embodiment of the present, because it allows an HRTF basis set consisting of only 7 filters ($H_W(n)$, $H_x(n)$, $H_y(n)$, $H_{x2}(n)$, $H_{y2}(n)$, $H_{x3}(n)$, and $H_{y3}(n)$) to be used to generate a left ear (and right ear) HRTF filter for any arrival direction in the horizontal plane, with a high degree of phase accuracy for frequencies up to the coupling frequency (e.g., up to 1000 Hz or more).

We next describe the use of small HRTF basis sets (each of which determines a coupled HRTF set) for signal-mixing in accordance with embodiments of the present invention.

It is possible to implement an HRTF mapper as an apparatus which employs a small HRTF basis set (e.g., of the type defined with reference to equations 1.10) to determine a coupled HRTF set, and to perform signal-mixing using such an apparatus in accordance with embodiments of the present invention.

Figure 10:
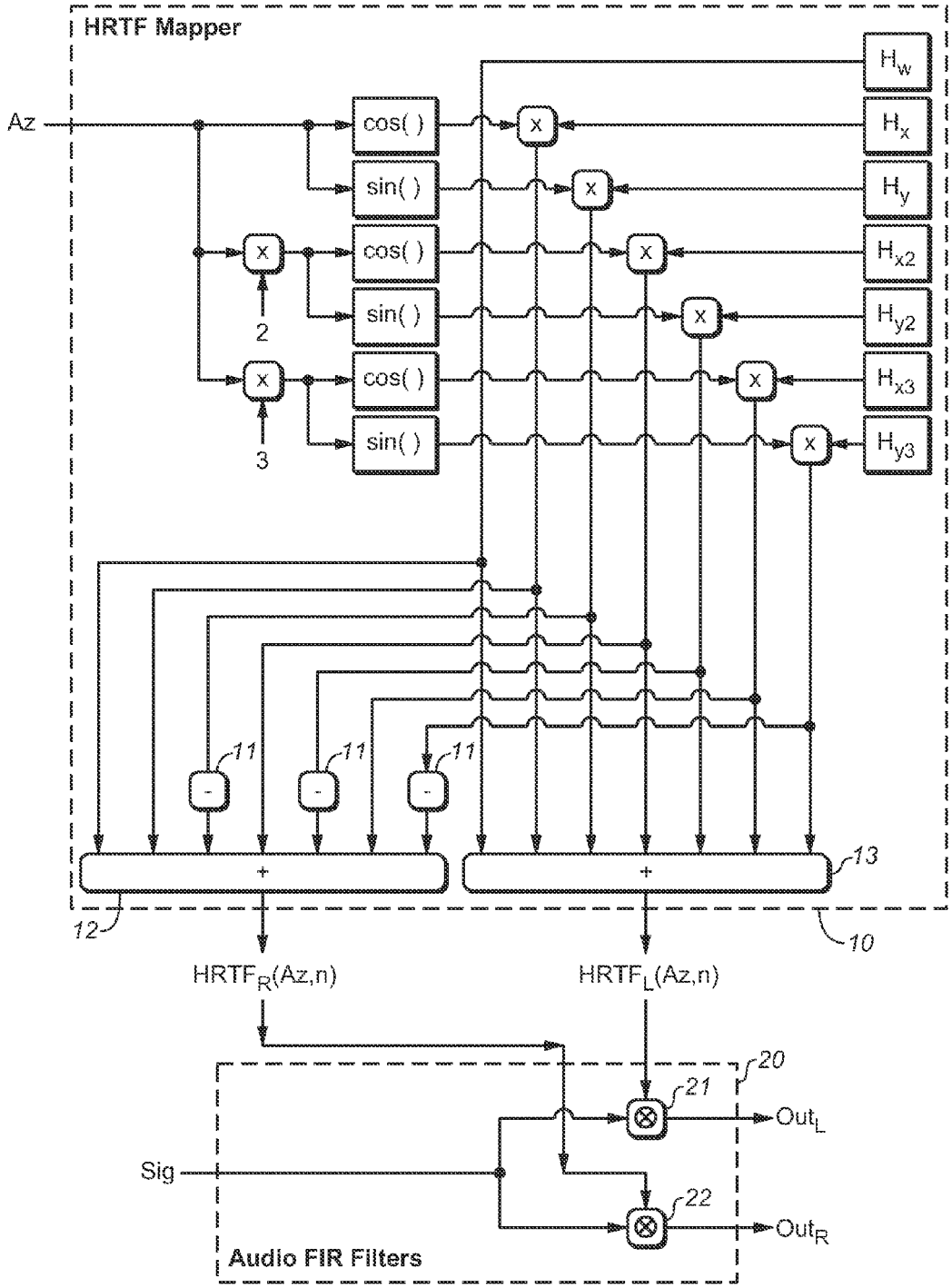
FIG. 10 is a block diagram of an embodiment of the inventive system, which includes HRTF mapper 10 and audio processor 20, and is configured to process a monophonic audio signal, for presentation over headphones, so as to provide a listener with an impression of a sound located at a specified Azimuth angle, Az.

HRTF mapper 10 of FIG. 10 is an example of such an HRTF mapper which employs the small HRTF basis set defined with reference to equations 1.10, to determine a coupled HRTF set. The FIG. 10 apparatus also includes audio processor 20 (which is a virtualizer) configured to process a monophonic audio signal ("Sig"), to generate left and right audio output channels ($Out_L$ and $Out_R$) for presentation over headphones, so as to provide a listener with an impression of a sound located at a specified Azimuth angle, Az.

In the system of FIG. 10, a single audio input channel (Sig) is processed by two FIR filters 21 and 22 (each labeled with the convolution operator, ⊗), implemented by processor 20, to produce the left and right ear signals, $Out_L$ and $Out_R$ respectively (for presentation over headphones). The filter coefficients for left ear FIR filter 21 are determined in mapper 10 from the HRTF basis set ($H_W$, $H_X$, $H_Y$, $H_{X2}$, $H_{Y2}$, $H_{X3}$, $H_{Y3}$ of equations 1.10) by weighting each of the HRTF basis set coefficients with a corresponding one of the sine and cosine functions (shown in equations 1.10) of the azimuth angle, Az (i.e., $H_W(n)$ is not weighted, $H_x(n)$ is multiplied by cos(Az), $H_Y(n)$ is multiplied by sin(Az), and so on), and summing the seven weighted coefficients (including $H_W(n)$), for each value of n, in summation stage 13. The filter coefficients for right ear FIR filter 22 are determined in mapper 10 from the HRTF basis set ($H_W$, $H_X$, $H_Y$, $H_{X2}$, $H_{Y2}$, $H_{X3}$, $H_{Y3}$ of equations 1.10) by weighting each of the HRTF basis set coefficients with a corresponding one of the sine and cosine functions (shown in equations 1.10) of the azimuth angle, Az (i.e., $H_W(n)$ is not weighted, $H_X(n)$ is multiplied by cos(Az), $H_Y(n)$ is multiplied by sin(Az), and so on), multiplying each of the weighted versions of coefficients $H_Y(n)$, $H_{Y2}(n)$, and $H_{Y3}$ (n) by negative one (in multiplication elements 11) and summing the resulting seven weighted coefficients in summation stage 12.

Thus, the FIG. 10 system breaks the processing into two main components. First, HRTF mapper 10 is used to compute the FIR filter coefficients, $HRTF_L(Az,n)$ and $HRTF_R(Az,n)$, that are applied by filters 21 and 22. Secondly, FIR filters 21 and 22 (of processor 20) are configured with the FIR filter coefficients that were computed by the HRTF mapper, and the configured filters 21 and 22 then process the audio input to produce the headphone output signals.

Figure 11:
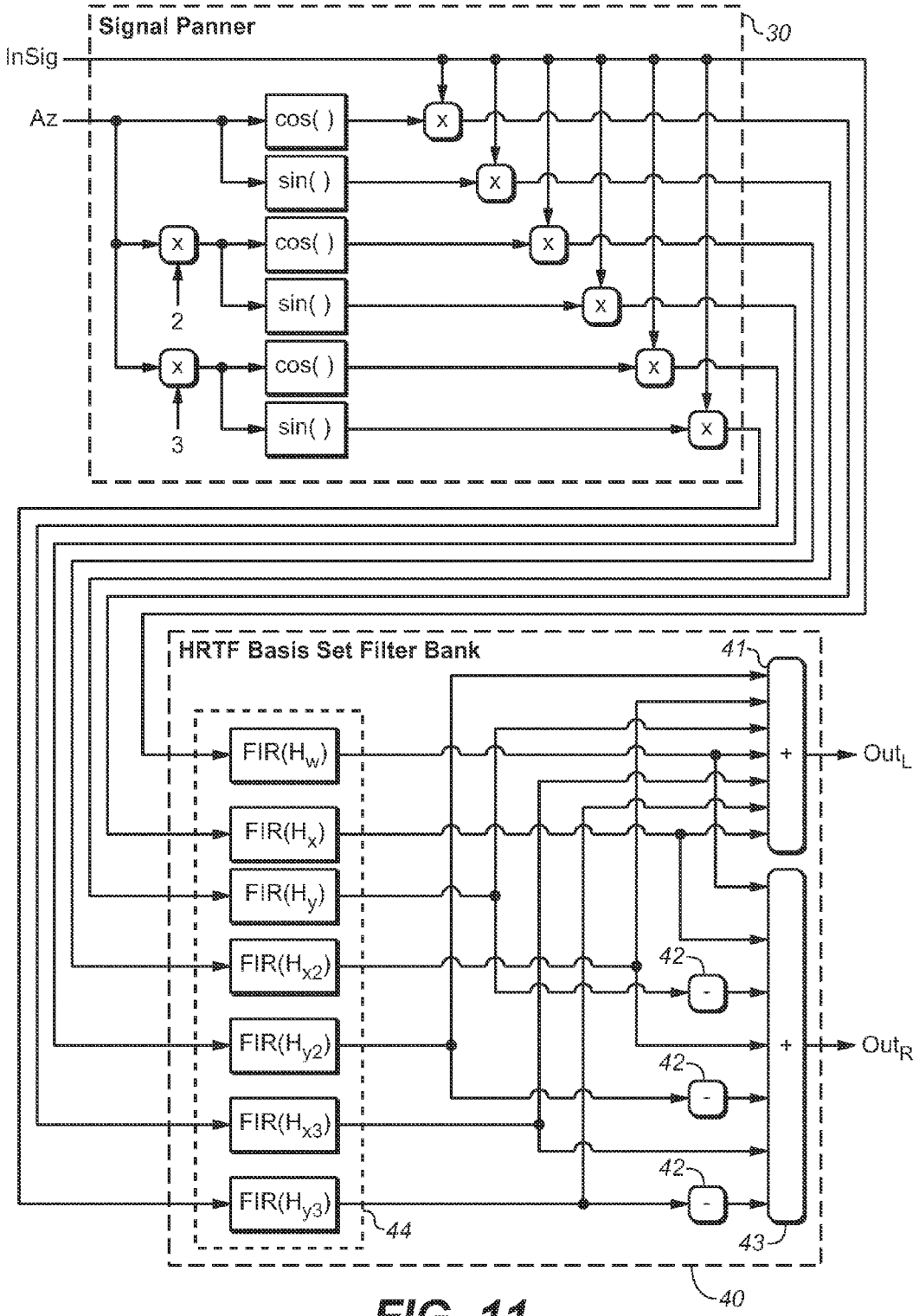
FIG. 11 is a block diagram of another embodiment of the inventive system, which includes mixer 30 and HRTF mapper 40

A mixing system can be configured in a very different way (as shown in FIG. 11) to produce the same result (produced by the FIG. 10 system) in response to the same input audio signal and specified arrival direction (Azimuth angle). The FIG. 11 apparatus (which implements a virtualizer) is configured to process a monophonic audio signal ("InSig"), to generate left and right (binaural) audio output channels ($Out_L$ and $Out_R$), which may be presented over headphones so as to provide a listener with an impression of a sound located at a specified arrival direction (Azimuth angle, Az).

In FIG. 11, signal panning stage (panner) 30 generates a set of seven intermediate signals in response to the input signal ("InSig"), as per the following equations:

$$W=\text{InSig}$$

$$X=\text{InSig}\times\cos(Az)$$

$$Y=\text{InSig}\times\sin(Az)$$

$$X2=\text{InSig}\times\cos(2Az)$$

$$Y2=\text{InSig}\times\sin(2Az)$$

$$X3=\text{InSig}\times\cos(3Az)$$

$$Y3=\text{InSig}\times\sin(3Az) \quad (1.11),$$

where Az is the specified Azimuth angle.

Each of the seven intermediate signals is then filtered in HRTF filter stage 40, by convolving it (in stage 44) with the FIR filter coefficients of a corresponding FIR filter of an HRTF Basis set (i.e., InSig is convolved with coefficients $H_W$, InSig cos(Az) is convolved with coefficients $H_X$ of equations 1.10, InSig·sin(Az) is convolved with coefficients $H_Y$ of equations 1.10, InSig·cos(2Az) is convolved with coefficients $H_{X2}$ of equations 1.10, InSig sin(2Az) is convolved with coefficients $H_{Y2}$ of equations 1.10, InSig cos (3Az) is convolved with coefficients $H_{X3}$ of equations 1.10, and InSig sin(3Az) is convolved with coefficients $H_{Y3}$ of equations 1.10). The outputs of convolution stage 44, are then added (in summation stage 41) to generate the left channel output signal, $Out_L$. Some of the outputs of convolution stage 44 are multiplied by negative one in multiplication elements 42 (i.e., each of sin(Az) convolved with coefficients HY, InSig sin(2Az) convolved with coefficients $H_{Y2}$, and InSig sin(3Az) convolved with coefficients $H_{Y3}$ is multiplied by negative one in elements 42), and the outputs of the multiplication elements 42 are added to the other outputs of the convolution stage (in summation stage 43) to generate the right channel output signal, $Out_R$. The filter coefficients applied in convolution stage 44 are those of the HRTF basis set $H_W$, $H_X$, $H_Y$, $H_{X2}$, $H_{Y2}$, $H_{X3}$, $H_{Y3}$ of equations 1.10.

If a set of M input signals, $InSig_m$, is to be processed for binaural playback, a single set of intermediate signals may be produced in panner 30, with all M input signals present:

$$W=\sum_{m=1}^{M} InSig_m \quad (1.12)$$

$$X=\sum_{m=1}^{M} InSig_m\times\cos(Az_m)$$

$$Y=\sum_{m=1}^{M} InSig_m\times\sin(Az_m)$$

$$X2=\sum_{m=1}^{M} InSig_m\times\cos(2Az_m)$$

-continued $$Y2 = \sum_{m=1}^{M} InSig_m \times \sin(2Az_m)$$

$$X3 = \sum_{m=1}^{M} InSig_m \times \cos(3Az_m)$$

$$Y3 = \sum_{m=1}^{M} InSig_m \times \sin(3Az_m).$$

Once these intermediate signals have been generated, they are filtered in convolution stage 44 as follows:

$$W_{filtered} = W \otimes H_W$$

$$X_{filtered} = X \otimes H_X$$

$$Y_{filtered} = Y \otimes H_Y$$

$$X2_{filtered} = X2 \otimes H_{X2}$$

$$Y2_{filtered} = Y2 \otimes H_{Y2}$$

$$X3_{filtered} = X3 \otimes H_{X3}$$

$$Y3_{filtered} = Y3 \otimes H_{Y3} \quad (1.13)$$

and the left and right ear output signals are derived as follows:

$$Out_L = W_{filtered} + X_{filtered} + Y_{filtered} + X2_{filtered} + Y2_{filtered} + X3_{filtered} + Y3_{filtered}$$

$$Out_R = W_{filtered} + X_{filtered} - Y_{filtered} + X2_{filtered} - Y2_{filtered} + X3_{filtered} - Y3_{filtered} \quad (1.14).$$

Hence, the combined operations shown in equations (1.12), (1.13), and (1.14) enable a set of M input signals, $\{InSig_m: 1 \le m \le M\}$ (each with a corresponding azimuth angle, $Az_m$) to be rendered binaurally, using only 7 FIR filters. There may be a different azimuth angle, $Az_m$, for each of the input signals. This means that the small number of FIR filter sets in the HRTF Basis set enables an efficient method for binaurally rendering large numbers of input signals, by applying the process implemented by the FIG. 11 system to multiple input signals as shown in FIG. 12.

Figure 12:
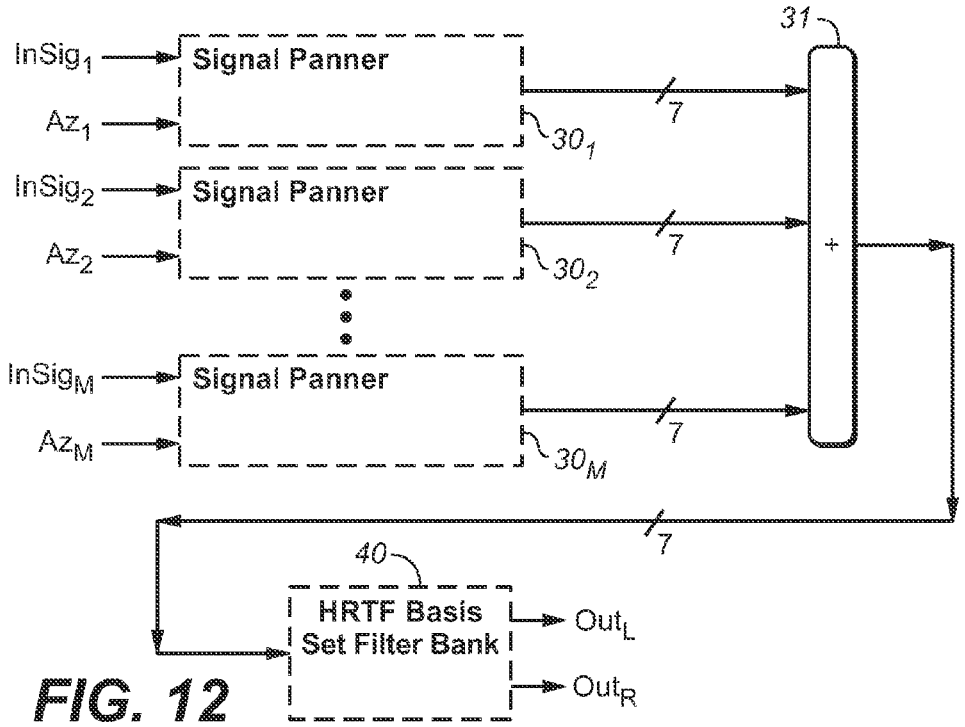
FIG. 12 is a block diagram of another embodiment of the inventive system.

In FIG. 12, each of blocks 30; represents panner 30 of FIG. 11 during processing of the "i"th input signal (where index i ranges from 1 through M), and summation stage 31 is coupled and configured to sum outputs generated in blocks $\mathbf{30}_i$-$\mathbf{30}_M$ to generate the seven intermediate signals set forth in equations 1.12.

Another embodiment of the inventive system and method for processing a set of M input signals, $InSig_m$, will be described with reference to FIG. 13. In this embodiment, M input signals are processed for binaural playback, using the fact that intermediate signal formats may also be modified by up-mixing. In this context, "up-mixing" refers to a process whereby a lower-resolution intermediate signal (one composed of a lesser number of channels) is processed to create a higher-resolution intermediate signal (composed of a larger number of intermediate signals). Many methods are known in the art for upmixing such intermediate signals, for example, including those described in U.S. Pat. No. 8,103,006, to the current inventor (and assigned to the assignee of the present invention). The upmixing process allows a lower resolution intermediate signal to be used, with upmixing carried out prior to the HRTF filtering, as shown in FIG. 13.

Figure 13:
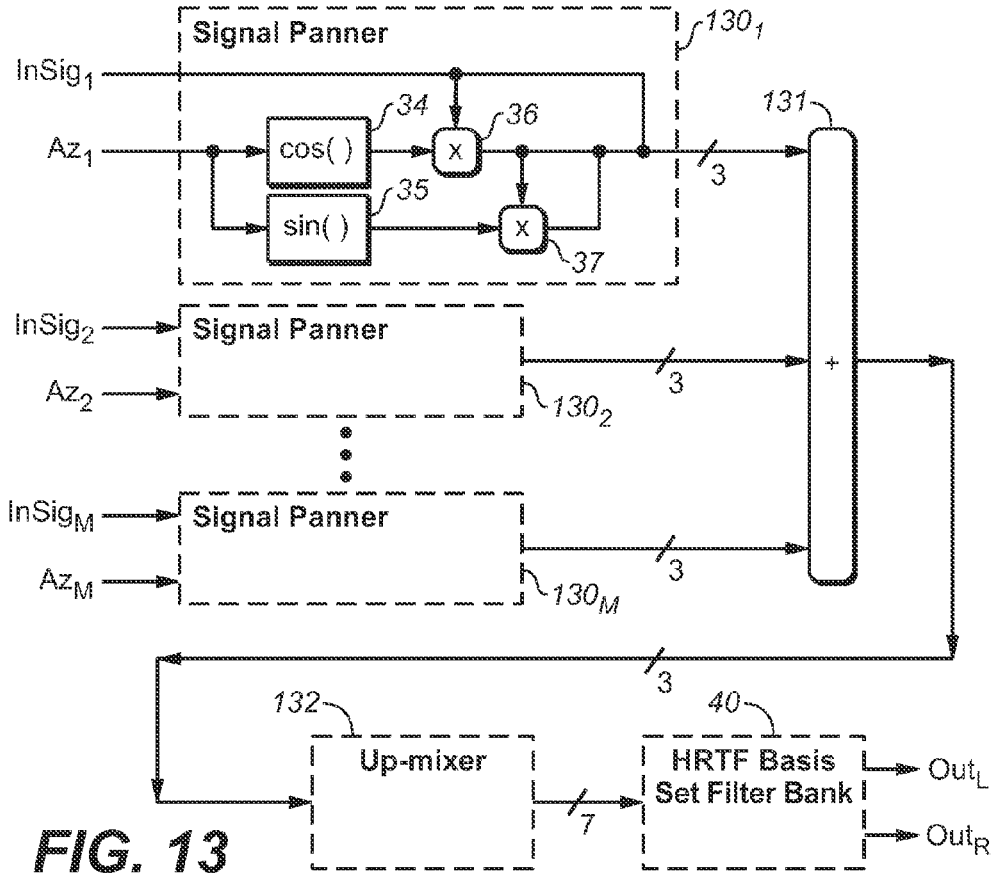
FIG. 13 is a block diagram of another embodiment of the inventive system.

In FIG. 13, each of blocks 130, represents the same panner (to be referred to as the panner of FIG. 13) during processing of the "i"th input signal, InSig, (where index i ranges from 1 through M), and summation stage 131 is coupled and configured to sum the outputs generated in blocks $\mathbf{130}_1$-$\mathbf{130}_M$ to generate intermediate signals which are upmixed in upmixing stage 132. Stage 40 (which is identical to stage 40 of FIG. 11) filters the output of stage 132.

The panner of FIG. 13 passes through the current input signal ("InSig,") to stage 131. The panner of FIG. 13 includes stages 34 and 35, which generate the values cos ($Az_i$) and sin($Az_i$), respectively, in response to the current Azimuth angle $Az_i$. The panner of FIG. 13 also includes multiplication stages 36 and 37, which generate the values $InSig_i \cdot \cos(Az_i)$ and InSig, $\sin(Az_i)$, respectively, in response to the current input signal $InSig_i$ and the outputs of stages 34 and 35.

Summation stage 131 is coupled and configured to sum the outputs generated in blocks $\mathbf{130}_1$-$\mathbf{130}_M$ to generate three intermediate signals as follows: stage 131 sums the M outputs "InSig," to generate one intermediate signal; stage 131 sums the M values InSig, $\cos(Az_i)$ to generate a second intermediate signal, and stage 131 sums the M values InSig, $\sin(Az_i)$ to generate a third intermediate signal. Each of the three intermediate signals corresponds to a different channel. Upmixing stage 132 upmixes the three intermediate signals from stage 131 (e.g., in a conventional manner) to generate seven upmixed intermediate signals, each of which corresponds to a different one of seven channels. Stage 40 filters these seven upmixed signals in the same manner that stage 40 of FIG. 11 filters the seven signals asserted thereto by stage 30 of FIG. 11.

The particular form of the intermediate signals described above (with reference to FIGS. 11, 12, and 13) may be modified, to form alternative basis sets for the HRTF basis set decomposition, as will be appreciated by one of ordinary skill in the art. In all such embodiments of the invention, use of an HRTF basis set to simplify audio processing (e.g., as in the system of FIG. 12 or FIG. 13) is only possible if the HRTF basis set has been constructed so as to allow HRTF filters to be created by linear mixing (e.g., by elements 34, 35, 36, 37, 131, and 132 of FIG. 13, or by the elements of stage 10 shown in FIG. 10). If the basis set determines a set of the inventive coupled HRTF filters, it will allow HRTF filters to be created by that have been modified to be "coupled" are more amenable to linear mixing.

Typical embodiments of the present invention generate (or determine and use) a set of coupled HRTFs which satisfies the following three criteria (sometimes referred to herein for convenience as the "Golden Rule"):

1. The inter-aural phase response of each pair of HRTF filters (i.e., each left ear HRTF and right ear HRTF created for a specified arrival direction) that are created from the set of coupled HRTFs (by a process of linear mixing) match the inter-aural phase response of a corresponding pair of left ear and right ear normal HRTFs with less than 20% phase error (or more preferably, with less than 5% phase error), for all frequencies below the coupling frequency. In other words, the absolute value of the difference between the phase of the left ear HRTF created from the set and the phase of the corresponding right ear HRTF created from the set differs by less than 20% (or more preferably, less than 5%) from the absolute value of the difference between the phase of the corresponding left ear normal HRTF and the phase of the corresponding right ear normal HRTF, at each frequency below the coupling frequency.

The coupling frequency is greater than 700 Hz and is typically less than 4 kHz. At frequencies above the coupling frequency, the phase response of the HRTF filters that are created from the set (by a process of linear mixing) deviate from the behavior of normal HRTFs, such that the interaural group delay (at such high frequencies) is significantly reduced compared to normal HRTFs;

2. The magnitude response of each HRTF filter created from the set (by a process of linear mixing) for an arrival direction is within the range expected for normal HRTFs for the arrival direction (e.g., in the sense that it does not exhibit significant comb filtering distortion relative to the magnitude response of a typical normal HRTF filter for the arrival direction); and
3. The range of arrival angles that can be spanned by the mixing process (to generate an HRTF pair for each arrival angle in the range by a process of linear mixing coupled HRTFs in the set) is at least 60 degrees (and preferably is 360 degrees).

In embodiments in which the inventive method includes determination of an HRTF basis set which in turn determines a coupled HRTF set (e.g., by performing a least-mean-squares fit or another fitting process to determine coefficients of the HRTF basis set such that the HRTF basis set determines the coupled HRTF set to within adequate accuracy), or uses such an HRTF basis set to determine a pair of HRTFs in response to an arrival direction, the coupled HRTF set preferably satisfies the Golden Rule.

Typically, a coupled HRTF set which satisfies the Golden Rule comprises data values which determine a set of left ear coupled HRTFs and a set of right ear coupled HRTFs for arrival angles which span a range of arrival angles, a left ear HRTF determined (by linear mixing in accordance with an embodiment of the invention) for any arrival angle in the range and a right ear HRTF determined (by linear mixing in accordance with an embodiment of the invention) for said arrival angle have an inter-aural phase response which matches the inter-aural phase response of a typical left ear normal HRTF for said arrival angle relative to a typical right ear normal HRTF for said arrival angle with less than 20% (and preferably, less than 5%) phase error for all frequencies below the coupling frequency (where the coupling frequency is greater than 700 Hz and typically less than 4 kHz), and the left ear HRTF determined (by linear mixing in accordance with the embodiment of the invention) for any arrival angle in the range has a magnitude response which does not exhibit significant comb filtering distortion relative to the magnitude response of the typical left ear normal HRTF for said arrival angle, and the right ear HRTF determined (by linear mixing in accordance with the embodiment of the invention) for any arrival angle in the range has a magnitude response which does not exhibit significant comb filtering distortion relative to the magnitude response of the typical left ear normal HRTF for said arrival angle, wherein said range of arrival angles is at least 60 degrees (preferably, said range of arrival angles is 360 degrees).

It has been proposed to simplify HRTF libraries via spherical harmonic basis sets (e.g., as described in U.S. Pat. No. 6,021,206 to the current inventor), but all such previous attempts to simplify the HRTFs by use of a spherical harmonic basis have suffered from significant combing problems of the type described herein. Hence, the conventionally-determined spherical-harmonic HRTF libraries did not satisfy the second criterion of the Golden Rule set forth above.

Also, some early attempts to create binauralizing filters with analog circuit elements resulted in HRTF filters that satisfied the second criterion of the Golden Rule as an accidental side-effect of the limitations of analog circuit techniques. For example, such an HRTF filter is described in the paper by Bauer, entitled "Stereophonic Earphones and Binaural Loudspeakers," in Journal of the Audio Engineering Society, April 1961, Volume 9, No. 2. However, such HRTFs did not satisfy the first criterion of the Golden Rule.

Typical embodiments of the invention are methods of generating a set of coupled HRTFs which represent angles of arrival that span a given space (e.g., horizontal plane) and are quantized to a particular angular resolution (e.g., a set of coupled HRTFs representing angles of arrival with an angular resolution of 30 degrees around a 360 degree circle—0, 30, 60, . . . , 300, and 330 degrees). The coupled HRTFs in the set are constructed such that they differ from the true (i.e., measured) HRTFs for the angles of arrival in the set (except for 0 and 180 degree azimuth, since these HRTF angles typically have zero inter-aural phase, and therefore do not require any special processing to make them obey the Golden rule).

Specifically, they differ in that the phase response of the HRTFs is intentionally altered above a specific coupling frequency. More specifically, the phases are altered such that the phase responses of the HRTFs in the set are coupled (i.e., are the same or nearly the same) above the coupling frequency. Typically, the coupling frequency above which the phase responses are coupled is chosen in dependence on the angular resolution of the HRTFs included in the set. Preferably, the cutoff frequency is chosen such that as the angular resolution of the set increases (i.e., more coupled HRTFs are added to the set), the coupling frequency also increases.

In alternative embodiments, each HRTF applied (or each of a subset of the HRTFs applied) applied in accordance with the invention is defined and applied in the frequency domain (e.g., each signal to be transformed in accordance with such HRTF undergoes time-domain to frequency-domain transformation, the HRTF is then applied to the resulting frequency components, and the transformed components then undergo a frequency-domain to time-domain transformation).

In some embodiments, the inventive system is or includes a general purpose processor coupled to receive or to generate input data indicative of at least one audio input channel, and programmed with software (or firmware) and/or otherwise configured (e.g., in response to control data) to perform any of a variety of operations on the input data, including an embodiment of the inventive method. Such a general purpose processor would typically be coupled to an input device (e.g., a mouse and/or a keyboard), a memory, and a display device. For example, the system of FIG. 9, 10, 11, 12, or 13 could be implemented as a general purpose processor, programmed and/or otherwise configured to perform any of a variety of operations on input audio data, including an embodiment of the inventive method, to generate audio output data. A conventional digital-to-analog converter (DAC) could operate on the audio output data to generate analog versions of output audio signals for reproduction by physical speakers.

FIG. 9 is a block diagram of a system (which can be implemented as a programmable audio DSP) that has been configured to perform an embodiment of the inventive method. The system includes HRTF filter stage 9, coupled to receive an audio input signal (e.g., frequency domain audio data indicative of sound, or time domain audio data indicative of sound), and HRTF mapper 7. HRTF mapper 7 includes memory 8 which stores data determining a set of coupled HRTFs (e.g., data determining an HRTF basis set which in turn determines a coupled HRTF set), and is coupled to receive data ("Arrival Direction") indicative of an arrival direction (e.g., specified as an angle or as a unit-vector) corresponding to a set of input audio data asserted to stage 9. In typical implementations, mapper 7 implements a look-up table configured to retrieve from memory 8, in response to the Arrival Direction data, data sufficient to perform linear mixing to determine an HRTF pair (a left ear HRTF and a right ear HRTF) for the arrival direction.

Mapper 7 is optionally coupled to an external computer readable medium 8*a* which stores data determining the set of coupled HRTFs (and optionally also code for programming mapper 7 and/or stage 9 to perform an embodiment of the inventive method), and mapper 7 is configured to access (from medium 8*a*) data indicative of the set of coupled HRTFs (e.g., data indicative of selected ones of coupled HRTFs of the set). Mapper 7 optionally does not include memory 8 when mapper 7 is so configured to access external medium 8*a*. The data determining the set of coupled HRTFs (stored in memory 8 or accessed by mapper 7 from an external medium) can be coefficients of an HRTF basis set which determines the set of coupled HRTFs.

Mapper 7 is configured to determine a pair of HRTF impulse responses (a left-ear response and a right-ear response) in response to a specified direction of arrival (e.g., an arrival direction, specified as an angle or as a unit-vector, corresponding to a set of input audio data). Mapper 7 is configured to determine each HRTF for the specified direction by performing linear interpolation on coupled HRTFs in the set (by performing linear mixing on values determining the coupled HRTFs). Typically, the interpolation is between coupled HRTFs in the set having corresponding arrival directions close to the specified direction. Alternatively, mapper 7 is configured to access coefficients of an HRTF basis set (which determines the set of coupled HRTFs) and to perform linear mixing on the coefficients to determine each HRTF for the specified direction.

Stage 9 (which is a virtualizer) is configured to process data indicative of monophonic input audio ("Input Audio"), including by applying the HRTF pair (determined by mapper 7) thereto, to generate left and right channel output audio signals ($\text{Output}_L$ and $\text{Output}_R$). For example, the output audio signals may be suitable for rendering over headphones, so as to provide a listener with an impression of sound emitted from a source at the specified arrival direction. If data indicative of a sequence of arrival directions (for a set of input audio data) is asserted to the FIG. 9 system, stage 9 may perform HRTF filtering (using a sequence of HRTF pairs determined by mapper 7 in response to the arrival direction data) to generate a sequence of left and right channel output audio signals that can be rendered to provide a listener with an impression of sound emitted from a source panning through the sequence of arrival directions.

In operation, an audio DSP that has been configured to perform surround sound virtualization in accordance with the invention (e.g., the virtualizer system of FIG. 9, or the system of any of FIG. 10, 11, 12, or 13) is coupled to receive at least one audio input signal, and the DSP typically performs a variety of operations on the input audio in addition to (as well as) filtering by an HRTF. In accordance with various embodiments of the invention, an audio DSP is operable to perform an embodiment of the inventive method after being configured (e.g., programmed) to employ a coupled HRTF set (e.g., an HRTF basis set which determines a coupled HRTF set) to generate at least one output audio signal in response to each input audio signal by performing the method on the input audio signal(s).

Other aspects of the invention are a computer readable medium (e.g., a disc) which stores (in tangible form) code for programming a processor or other system to perform any embodiment of the inventive method, and computer readable medium (e.g., a disc) which stores (in tangible form) data which determine a set of coupled HRTFs, where the set of coupled HRTFs has been determined in accordance with an embodiment of the invention (e.g., to satisfy the Golden Rule described herein). An example of such a medium is computer readable medium 8*a* of FIG. 9.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method for determining and applying a head-related transfer function (HRTF), said method including the steps of:

(a) performing, in response to a signal indicative of an arrival direction, linear mixing using data of a coupled HRTF set to determine an HRTF for the arrival direction, where the coupled HRTF set comprises data values which determine a set of coupled HRTFs, the set of coupled HRTFs comprising a set of left ear coupled HRTFs and a set of right ear coupled HRTFs for a plurality of arrival directions which span a range of arrival directions, wherein the coupled HRTFs are determined from normal HRTFs for the same arrival directions by altering the phase response of each normal HRTF above a coupling frequency so that the difference between the phase of a left ear coupled HRTF and a right ear coupled HRTF for the same arrival direction is at least substantially constant as a function of frequency, for all frequencies substantially above the coupling frequency; and applying the HRTF for the arrival direction to at least one input audio signal to generate at least one output audio signal for application to at least one speaker or to or at least one amplifier and at least one speaker in series.

2. The method of claim 1, further including the step of:

(b) performing HRTF filtering on an audio input signal using the HRTF determined in step (a) for the arrival direction.

3. The method of claim 1, wherein the coupled HRTF set is an HRTF basis set comprising coefficients which determine the set of coupled HRTFs, and step (a) includes the step of performing linear mixing using coefficients of the HRTF basis set to determine the HRTF for the arrival direction.

4. The method of claim 1, wherein the step (a) includes the step of performing linear mixing on data indicative of coupled HRTFs determined by the coupled HRTF set, and data indicative of the arrival direction, and wherein the HRTF determined for the arrival direction is an interpolated version of the coupled HRTFs having a magnitude response which does not exhibit significant comb filtering distortion.

5. The method of claim 1, wherein step (a) includes the step of performing linear mixing on the data of the coupled HRTF set to determine a left ear HRTF for the arrival direction and a right ear HRTF for the arrival direction.

6. The method of claim 5, wherein the coupled HRTF set comprises data values which determine a set of left ear coupled HRTFs and a set of right ear coupled HRTFs for arrival angles which span a range of arrival angles, the left ear HRTF determined in step (a) for any arrival angle in the range and the right ear HRTF determined in step (a) for said arrival angle have an inter-aural phase response which matches the inter-aural phase response of a typical left ear normal HRTF for said arrival angle and a typical right ear normal HRTF for said arrival angle with less than 20% phase error for all frequencies below the coupling frequency, where the coupling frequency is greater than 700 Hz, and the left ear HRTF determined in step (a) for any arrival angle in the range has a magnitude response which does not exhibit significant comb filtering distortion relative to the magnitude response of the typical left ear normal HRTF for said arrival angle, and the right ear HRTF determined in step (a) for any arrival angle in the range has a magnitude response which does not exhibit significant comb filtering distortion relative to the magnitude response of the typical right ear normal HRTF for said arrival angle, wherein said range of arrival angles is at least 60 degrees.

7. The method of claim 1, wherein the coupled HRTFs are determined from normal HRTFs for the same arrival directions by altering the phase response of each normal HRTF above a coupling frequency so that the phase response of each coupled HRTF is substantially constant as a function of frequency for all frequencies substantially above the coupling frequency.

8. A system configured to determine an interpolated head-related transfer function (HRTF), said system including:

a memory, which stores data values which determine coupled HRTFs of a coupled HRTF set, wherein the coupled HRTF set includes a set of left ear coupled HRTFs for a set of arrival directions which span a range of arrival directions and a set of right ear coupled HRTFs for the set of arrival directions, wherein for each arrival direction of the set of arrival directions, the set of right ear coupled HRTFs includes a right ear coupled HRTF for the arrival direction and the set of left ear coupled HRTFs includes a left ear coupled HRTF for the arrival direction; and a processing subsystem, coupled to receive a signal indicative of an arrival direction, and configured to perform, in response to the signal, linear mixing of at least some of the data values which determine coupled HRTFs of the coupled HRTF set to generate data which determine an interpolated HRTF for the arrival direction, wherein the arrival direction is any of the arrival directions in the range, wherein the coupled HRTFs are determined from normal HRTFs for the same arrival directions by altering the phase response of each normal HRTF above a coupling frequency so that the difference between the phase of a left ear coupled HRTF and a right ear coupled HRTF for the same arrival direction is at least substantially constant as a function of frequency, for all frequencies substantially above the coupling frequency, wherein the processing subsystem is configured to apply the interpolated HRTF for the arrival direction to at least one input audio signal to generate at least one output audio signal for application to at least one speaker or to or at least one amplifier and at least one speaker in series.

9. The system of claim 8, further including a HRTF filter subsystem coupled to receive the data indicative of the interpolated HRTF for the arrival direction, wherein the HRTF filter subsystem is coupled to receive an audio input signal and configured to filter said audio input signal in response to the data indicative of the interpolated HRTF, by applying said interpolated HRTF to the audio input signal.

10. The system of claim 8, wherein said data values are coefficients of an HRTF basis set, and the HRTF basis set determines the coupled HRTF set.

11. The system of claim 8, wherein the interpolated HRTF has a magnitude response which does not exhibit significant comb filtering distortion.

12. The system of claim 8, wherein the arrival directions in the range span at least 60 degrees in a plane.

13. The system of claim 8, wherein the interpolated HRTF for the arrival direction is determined by a left ear HRTF for the arrival direction and a right ear HRTF for the arrival direction.

14. The system of claim 13, wherein the coupled HRTF set comprises data values which determine a set of left ear coupled HRTFs and a set of right ear coupled HRTFs for arrival angles which span a range of arrival angles, the processing subsystem is configured to generate data which determine the left ear HRTF for any arrival angle in the range and data which determine the right ear HRTF for said arrival angle, such that said left ear HRTF and said right ear HRTF for said arrival angle have an inter-aural phase response which matches the inter-aural phase response of a typical left ear normal HRTF for said arrival angle and a typical right ear normal HRTF for said arrival angle with less than 20% phase error for all frequencies below the coupling frequency, where the coupling frequency is greater than 700 Hz, and the processing subsystem is configured to generate the data which determine the left ear HRTF for any arrival angle in the range and the data which determine the right ear HRTF for said arrival angle, such that said left ear HRTF for the arrival angle has a magnitude response which does not exhibit significant comb filtering distortion relative to the magnitude response of the typical left ear normal HRTF for said arrival angle, and such that said right ear HRTF for the arrival angle has a magnitude response which does not exhibit significant comb filtering distortion relative to the magnitude response of the typical right ear normal HRTF for said arrival angle, wherein said range of arrival angles is at least 60 degrees.

15. The system of claim 8, wherein the coupled HRTFs are determined from normal HRTFs for the same arrival directions by altering the phase response of each normal HRTF above a coupling frequency so that the phase response of each coupled HRTF is substantially constant as a function of frequency for all frequencies substantially above the coupling frequency.

16. The system of claim 9, wherein the audio input signal is monophonic audio data, and the HRTF filter subsystem implements a virtualizer configured to generate left and right channel output audio signals in response to the monophonic audio data, including by applying said interpolated HRTF to said monophonic input audio signal.

17. A method for determining a set of coupled head-related transfer functions (HRTFs) for a set of arrival angles which span a range of arrival angles, where the coupled HRTFs include a left ear coupled HRTF and a right ear coupled HRTF for each of the arrival angles in the set, said method including the steps of:

processing data indicative of a set of normal left ear HRTFs and a set of normal right ear HRTFs for each of the arrival angles in the set of arrival angles, to generate coupled HRTF data, where the coupled HRTF data are indicative of a left ear coupled HRTF and a right ear coupled HRTF for each of the arrival angles in the set, such that linear mixing of values of the coupled HRTF data, in response to data indicative of any arrival angle in the range, determines an interpolated HRTF for said any arrival angle in the range, said interpolated HRTF having a magnitude response which does not exhibit significant comb filtering distortion, wherein the processing includes altering the phase response of each of the normal left ear HRTFs and each of the normal right ear HRTFs above a coupling frequency so that the difference between the phase of each left ear coupled HRTF and each corresponding right ear coupled HRTF is at least substantially constant as a function of frequency, for all frequencies substantially above the coupling frequency; and determining at least one said interpolated HRTF for at least one arrival angle in the range, including by performing linear mixing of values of the coupled HRTF data, in response to data indicative of said at least one arrival angle in the range, and applying the interpolated HRTF to at least one input audio signal to generate at least one output audio signal for application to at least one speaker or to or at least one amplifier and at least one speaker in series.

18. The method of claim 17, wherein the coupled HRTF data are generated such that linear mixing of values of the coupled HRTF data, in response to data indicative of any arrival angle in the range, determines a left ear HRTF for the arrival angle and a right ear HRTF for the arrival angle, and wherein said left ear HRTF and said right ear HRTF for said arrival angle have an inter-aural phase response which matches the inter-aural phase response of a typical left ear normal HRTF for said arrival angle and a typical right ear normal HRTF for said arrival angle with less than 20% phase error for all frequencies below the coupling frequency, where the coupling frequency is greater than 700 Hz, and said left ear HRTF for the arrival angle has a magnitude response which does not exhibit significant comb filtering distortion relative to the magnitude response of the typical left ear normal HRTF for said arrival angle, and said right ear HRTF for the arrival angle has a magnitude response which does not exhibit significant comb filtering distortion relative to the magnitude response of the typical right ear normal HRTF for said arrival angle, wherein said range of arrival angles is at least 60 degrees.

19. The method of claim 17, wherein the coupled HRTF data are indicative of coupled HRTFs for the arrival angles, and the coupled HRTFs are determined from normal HRTFs for the same arrival angles by altering the phase response of each normal HRTF above a coupling frequency so that the phase response of each coupled HRTF is substantially constant as a function of frequency for all frequencies substantially above the coupling frequency.

20. The method of claim 17, also including a step of:

processing the coupled HRTF data to generate an HRTF basis set, including by performing a fitting process to determine values of the HRTF basis set, such that the HRTF basis set determines the coupled HRTF set to within predetermined accuracy.

21. The method of claim 1, wherein the coupling frequency is greater than 700 Hz.

22. The system of claim 8, wherein the coupling frequency is greater than 700 Hz.

23. The method of claim 17, wherein the coupling frequency is greater than 700 Hz.

* * * * *